US012338640B2

(12) United States Patent
Dutil et al.

(10) Patent No.: US 12,338,640 B2
(45) **Date of Patent: *Jun. 24, 2025**

(54) FLOOR PANEL SYSTEM

(71) Applicant: Bailey Metal Products Limited, Concord (CA)

(72) Inventors: Francois Dutil, Longueuil (CA); Michel Guerin, Caraquet (CA)

(73) Assignee: Bailey Metal Products Limited, Concord (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/564,422

(22) Filed: Dec. 29, 2021

(65) Prior Publication Data

US 2022/0120099 A1 Apr. 21, 2022

Related U.S. Application Data

(63) Continuation of application No. 16/356,282, filed on Mar. 18, 2019, now Pat. No. 11,242,689.
(Continued)

(30) Foreign Application Priority Data

Nov. 23, 2018 (CA) ..... CA 3025236

(51) Int. Cl.
*E04G 11/46* (2006.01)
*E04B 5/29* (2006.01)

(52) U.S. Cl.
CPC ..... *E04G 11/46* (2013.01); *E04B 5/29* (2013.01)

(58) Field of Classification Search
CPC ..... E04G 11/46; E04B 5/29
See application file for complete search history.

(56) References Cited

U.S. PATENT DOCUMENTS 602,274 A * 4/1898 Sill ..... E04B 5/29 52/339
1,073,906 A * 9/1913 Kahn ..... E04B 5/40 52/331

(Continued)

FOREIGN PATENT DOCUMENTS

EP 0165222 A2 12/1985
WO 96/06994 A1 3/1996

OTHER PUBLICATIONS

U.S. Appl. No. 16/356,282, filed Mar. 18, 2019.

*Primary Examiner* — Joshua K Ihezie
(74) *Attorney, Agent, or Firm* — Blake, Cassels & Graydon LLP; Laurie Wright; Christopher N. Hunter

(57) ABSTRACT

The present invention provides a prefabricated floor panel system used in stay in place formwork for pouring concrete floors. The prefabricated floor panel system includes a top and has walls depending downwardly at an upper lateral edge of the wall from each outermost lateral edge of the top, a lower lateral edge of each wall having a ledge extending outwardly away from the top. A first ledge of one prefabricated floor panel system is capable of overlying another ledge of an adjacent prefabricated floor panel system to allow for the one prefabricated floor panel system to be joined to the adjacent prefabricated floor panel system to form a channel. The first ledge of the prefabricated floor panel system is provided with a reinforcing bar spaced away from the wall and the first ledge of the prefabricated floor panel system, the reinforcing bar being supported by a plurality of a reinforcing bar chairs spaced along the length of the prefabricated panel system, the reinforcing bar chairs being attached to the first ledge or wall such that there are no significant interfering structures projecting from a lower surface of the first ledge. The other ledge of the prefabricated floor panel system is free of interfering structures above the (Continued)

ledge to allow the first ledge of one prefabricated floor panel system to overlie the other ledge of an adjacent prefabricated floor panel system to allow for the one prefabricated floor panel system to be joined to the adjacent prefabricated floor panel system to form a channel.

5 Claims, 21 Drawing Sheets

Related U.S. Application Data

(60) Provisional application No. 62/649,999, filed on Mar. 29, 2018.

(56) References Cited

U.S. PATENT DOCUMENTS 1,381,232 A * 6/1921 Pleister ..... F16L 3/06 248/69
1,410,633 A * 3/1922 White ..... E04C 5/18 404/136
1,615,651 A * 1/1927 Reynolds ..... E04C 5/18 52/687
1,620,501 A * 3/1927 Reinhold ..... E04C 5/18 404/136
1,708,352 A * 4/1929 Barton ..... E04C 5/168 52/646
1,841,720 A * 1/1932 Emigholz ..... E04C 5/18 52/687
1,864,043 A * 6/1932 Gruber ..... E04G 11/46 249/176
2,349,399 A * 5/1944 Powell ..... E04C 5/18 52/686
2,420,860 A * 5/1947 Burner ..... E04C 5/18 52/686
2,486,527 A * 11/1949 Hillberg ..... E01C 11/14 404/62
2,560,486 A * 7/1951 Shears ..... F16L 3/227 248/68.1
3,104,600 A * 9/1963 White ..... E01C 11/14 29/283
3,113,402 A * 12/1963 Butler ..... E04G 11/46 52/414
3,132,448 A * 5/1964 Phillips ..... E04C 5/18 404/136
3,397,497 A 8/1968 Shea et al.
3,812,636 A 5/1974 Albrecht et al.
3,881,833 A * 5/1975 McMullen ..... E01C 11/14 404/60
3,934,802 A * 1/1976 Jennings ..... F16L 55/035 248/216.1
4,034,529 A * 7/1977 Lampus ..... E04B 1/4185 52/690
4,085,558 A 4/1978 Albrecht
4,128,975 A * 12/1978 Abate ..... B28B 1/084 52/309.7
4,453,364 A 6/1984 Ting
4,603,523 A 8/1986 Albrecht et al.
4,689,867 A * 9/1987 Tolliver ..... E04C 5/18 249/91
4,885,884 A 12/1989 Schilger
5,056,348 A 10/1991 Albrecht et al.
5,317,846 A 6/1994 Michlovic
5,337,532 A * 8/1994 Reid ..... E04C 5/18 52/340
5,397,096 A * 3/1995 Nelson ..... E04G 11/46 249/176
5,448,866 A * 9/1995 Saito ..... E04B 5/04 52/694
5,551,204 A 9/1996 Mayrand
5,616,272 A * 4/1997 McCrystal ..... E04G 21/185 249/207
5,687,536 A 11/1997 Lin
5,700,385 A * 12/1997 Jones ..... E04C 5/18 404/136
D398,218 S * 9/1998 Coll ..... D8/356
6,006,483 A * 12/1999 Lee ..... E04B 5/40 52/630
6,112,482 A 9/2000 Wright et al.
6,361,000 B1 * 3/2002 Jette ..... H02G 3/0443 248/302
7,624,550 B2 12/2009 Ospina
7,770,851 B2 * 8/2010 Michaud ..... F16L 3/04 248/65
7,784,235 B2 * 8/2010 Cretti ..... E04C 5/065 52/332
8,205,412 B2 6/2012 Williams et al.
8,495,846 B2 7/2013 Bravinski
8,549,813 B2 * 10/2013 Martter ..... E04C 5/0645 52/649.1
9,740,799 B2 8/2017 Herdt et al.
10,320,173 B2 * 6/2019 Dalisay ..... H02G 3/30
2004/0231276 A1 * 11/2004 Patrick ..... E04B 5/40 52/634
2006/0059804 A1 * 3/2006 Brown ..... E04C 5/0604 52/223.13
2006/0137282 A1 * 6/2006 Anvick ..... E04C 5/0636 52/649.1
2006/0225374 A1 10/2006 Patrick
2007/0000197 A1 1/2007 Patrick et al.
2007/0175141 A1 8/2007 Smith et al.
2010/0000173 A1 * 1/2010 Thompson ..... E03C 1/021 52/689
2012/0291386 A1 11/2012 Miniscloux
2013/0047539 A1 2/2013 Katsalidis
2014/0144101 A1 5/2014 Kim et al.
2017/0268242 A1 9/2017 Molinelli

* cited by examiner 112
104
118
114
116
110
102

70
76
70
96
74
118
120
112
90
90
116
108
106
89
102
65

FLOOR PANEL SYSTEM

FIELD OF THE INVENTION

The present invention is directed to a floor panel system that is used in a permanent form for pouring concrete floors in multistory buildings, the floor panel system allowing for improved performance and economics when constructing multistory buildings.

BACKGROUND OF THE INVENTION

Multistory buildings are typically constructed of a concrete or steel frame and concrete floors. Once the frame is constructed, formwork is generally provided to allow the concrete floor to be poured on top of the formwork and tied into the frame. The formwork may be either removable in which case it is reused for each floor or it may be stay in place where it remains as part of the floor. The formwork is supported from below to allow the concrete to cure without any sagging of the floor. Once the concrete floor cures the removable formwork and the supporting structures to support the floor while the concrete is curing is raised up to the next level and the process is repeated. This process is very labor intensive and has a high risk of injury to the workers.

Stay-in-place formwork is generally built up from individual panels such as those marketed by the present applicant under the trademark ComSlab. With these systems, individual banded bundles of the floor panels are lifted up to the floor. The bundles are then un-banded and distributed on the support structures and the frame. The floor panels are then connected to each other and to the frame to complete the installation. While such systems can decrease the construction time as the formwork does not have to be removed and reinstalled for each floor, they do increase the cost and can create additional safety issues for the workers installing the formwork.

In order to overcome some of the disadvantages of formwork systems it has been proposed to provide prefabricated floor panels which cover a larger area of the floor than the formwork systems. Examples of such a prefabricated floor panels are given in U.S. Pat. No. 8,495,846 to Brzezinski, U.S. Pat. No. 8,205,412 to Williams et al. and EP 0165222 to A-Betong AB. All of these prefabricated floor panels have a layer of concrete and a system of reinforcing bars to reinforce the floor slab as it is poured on top of the floor panel. The floor panels are utilized by lifting them up and placing them between the frame of the building. Once they are tied into the frame of the building concrete is poured on top of the floor panels and allowed to cure to form the floor. While such prefabricated floor panels can reduce the time for the construction of the building as well as providing increased safety to the workers, they can increase the cost both because of the construction requirements of the prefabricated panels as well as the weight of the panels thereby reducing the number of panels that can be raised by the crane.

Thus, there still remains a need for a floor panel system which can be easily and quickly installed while providing the advantages of such a panel system.

SUMMARY OF THE INVENTION

The present invention provides a prefabricated floor panel system used in stay in place formwork for pouring concrete floors. The prefabricated floor panel system comprises a top and having walls depending downwardly at an upper lateral edge of the wall from each outermost lateral edge of the top, a lower lateral edge of each wall having a ledge extending outwardly away from the top. A first ledge of one prefabricated floor panel system is capable of overlying another ledge of an adjacent prefabricated floor panel system to allow for the one prefabricated floor panel system to be joined to the adjacent prefabricated floor panel system to form a channel. The first ledge of the prefabricated floor panel system is provided with a reinforcing bar spaced away from the wall and the first ledge of the prefabricated floor panel system, the reinforcing bar being supported by a plurality of a reinforcing bar chairs spaced along the length of the prefabricated panel system, the reinforcing bar chairs being attached to the first ledge or wall such that there are no significant interfering structures projecting from a lower surface of the first ledge. The other ledge of the prefabricated floor panel system being free of interfering structures above the ledge to allow the first ledge of one prefabricated floor panel system to overlie the other ledge of an adjacent prefabricated floor panel system to allow for the one prefabricated floor panel system to be joined to the adjacent prefabricated floor panel system to form a channel.

In an aspect of the invention, each of the ledges are free of interfering structures on both the upper and lower surfaces.

The present invention provides in a preferred aspect of the invention a floor panel used in stay-in-place formwork for pouring concrete floors. The floor panel comprises a top and having walls depending downwardly at an upper lateral edge of the wall from each outermost lateral edge of the top, a lower lateral edge of each wall having a ledge extending outwardly away from the top, the ledge of one floor panel being capable of overlying the ledge of an adjacent floor panel to allow for the one floor panel to be joined to the adjacent floor panel to form a channel. At least one outermost lateral edge of the floor panel is provided with a reinforcing bar spaced away from the wall and ledge of the floor panel such that there are no interfering structures between the ledge and the reinforcing bar to interfere with the joining of one floor panel to another floor panel by overlying the ledges of the floor panels. The reinforcing bar is supported by a plurality of reinforcing bar chairs being attached to the wall and/or the top of the floor panel and at a lower edge having a leg extending from and spaced away from the wall of the channel to a U-shaped reinforcing bar chair spaced away from the wall and ledge, the reinforcing bar being attached to the reinforcing bar chair. The free ledge of the other outermost lateral edge of the floor panel being capable of overlying the ledge of an adjacent floor panel to allow for the one floor panel to be joined to the adjacent floor panel to form a channel.

In an aspect of the invention, the floor panel system is provided with internal longitudinally extending channels, the channels having walls of a similar configuration to the walls at the outermost lateral edge of the top and a base of a similar configuration to the ledges of the walls at the outermost lateral edge of the top.

In an aspect of the invention, the floor panel system used in stay in place formwork for pouring concrete floors comprises a plurality of individual floor panels joined one to another along lateral edges of the floor panels. Each floor panel has a top and walls depending downwardly at an upper lateral edge of the wall from each lateral edge of the top, a lower lateral edge of each wall having a ledge extending outwardly away from the top. The ledge of one floor panel overlies the ledge of an adjacent floor panel to allow for the one floor panel to be joined to the adjacent floor panel to form a channel. Each of the channels formed is provided with at least one reinforcing bar spaced away from the walls and ledges of the joined floor panels. The reinforcing bar is supported by a plurality of a first reinforcing bar support spaced along the length of the channel, the first reinforcing bar chairs being attached by feet to a wall or ledge forming the channel and having legs extending from the feet to a U-shaped saddle for supporting and attaching the reinforcing bar spaced away from the walls and ledges of the joined floor panels. At least one free ledge along one lateral edge of the floor panel system is provided with a reinforcing bar spaced away from the wall and ledge of the panel such that there are no interfering structures between the ledge and the reinforcing bar to interfere with the joining of one floor panel system to another floor panel system by overlying the ledges of the floor panel systems. The reinforcing bar is supported by a plurality of a second reinforcing bar chair being attached to the wall and/or top of the panel and at a lower edge having a leg extending from and spaced away from the wall of the channel to a U-shaped reinforcing bar chair spaced away from the ledges, the reinforcing bar being attached to the reinforcing bar chair.

In another aspect of the invention, one or more of the walls, ledges and top are provided with reinforcing structures to strengthen the floor panel system.

In a further aspect of the invention, the reinforcing structures include ribs extending longitudinally of one or more of the walls, ledges and top.

In yet another aspect of the invention, the reinforcing structures include ribs extending laterally across one or both of the walls and top.

In a further aspect of the invention, the top is provided with a longitudinally extending rib adjacent the lateral edge of the top.

In another aspect of the invention, the reinforcing bar chair at the outermost lateral edge of the top has a hook at the top thereof which engages the longitudinally extending rib adjacent the lateral edge of the top.

In yet another aspect of the invention, each reinforcing bar is attached to the reinforcing bar chair by being welded to the reinforcing bar chair.

In a further aspect of the invention, the internal channel reinforcing bar chair comprises feet to be attached to the base of the internal channel, legs extending upwardly from the feet and a saddle to accept the reinforcing bar connecting the upper ends of the legs.

In another aspect of the invention, a first leg of the internal channel reinforcing bar chair extends generally perpendicularly from a first foot and a second leg extends rearwardly from a second foot, the saddle to accept the reinforcing bar having a U-shaped support extending generally perpendicularly across the channel from the top of the first leg and connected to the second leg by a laterally extending arm which will lie against the reinforcing bar.

In yet another aspect of the invention, the internal channel reinforcing bar chair is attached to the base of the internal channel by a clamp overlying the feet of the internal channel reinforcing bar chair, the clamp being attached to the base of the internal channel by a suitable fastening means.

In a further aspect of the invention, the reinforcing bar is attached to the internal channel reinforcing bar chair by being welded to the laterally extending arm of the internal channel reinforcing bar chair.

In another aspect of the invention, a plurality of lifting structures are provided spaced along the length of an internal channel to provide load support for lifting of panels and bundles of panels the lifting structure supporting the panel and in particular the panel top to either side of the lifting structure.

In a further aspect of the invention, the lifting structure has a lower region for overlying and being attached to the wall and/or base of the internal channel, the lower region being provided a plurality of holes to accept a fastening means to be fastened to the wall and/or base of the internal channel. The lifting structure has an upper region extending angularly away from the lower region such that the upper region is spaced away from the wall of the internal channel, the upper region being provided with a hole to accept the load supporting means, the hole being spaced away from a top edge of the upper region a sufficient distance to allow for the required strength to allow the load supporting means to lift the bundled floor panels without deformation of the lifting structure.

In yet another aspect of the invention, the lifting structure has a profile similar to that of the wall and ledge of the floor panel, the lifting structure having a wall of a height less than the wall of the floor panel, the top of the wall of the lifting structure having a relatively straight edge and the wall of the lifting structure being provided with a hole adjacent to the top edge to accept a load support means of a lifting device, the hole being spaced a sufficient distance below the top edge of the lifting structure to allow for the required strength to allow the load support means to support the bundled floor panels during lifting of the bundled floor panels without deformation of the lifting structure, the lower edge of the lifting structure being provided with a ledge extending outwardly and having the same profile as the ledge of the floor panel to allow the lifting structure to be easily attached to the ledge present at the bottom of the internal channel of the floor panel.

In a further aspect of the invention, the lifting structure is attached to the top of the ledge forming the base of the channel using the clamps and fastening means used to hold the reinforcing bar chair within the channel.

In another aspect of the invention, the internal longitudinally extending channels of the floor panel system is provided with a base of a sufficient width to accommodate at least two reinforcing bars in a side by side spaced apart configuration, the channel walls and walls at the outermost lateral edge of the top being of a reduced height to accommodate the wider ledge forming the base, as well as the ledges of the walls at the outermost lateral edge of the top.

BRIEF DESCRIPTION OF THE DRAWINGS

Preferred embodiments of the present invention are illustrated in the attached drawings, in which.

DETAILED DESCRIPTION OF THE PREFERRED EMBODIMENTS

Figure 1:
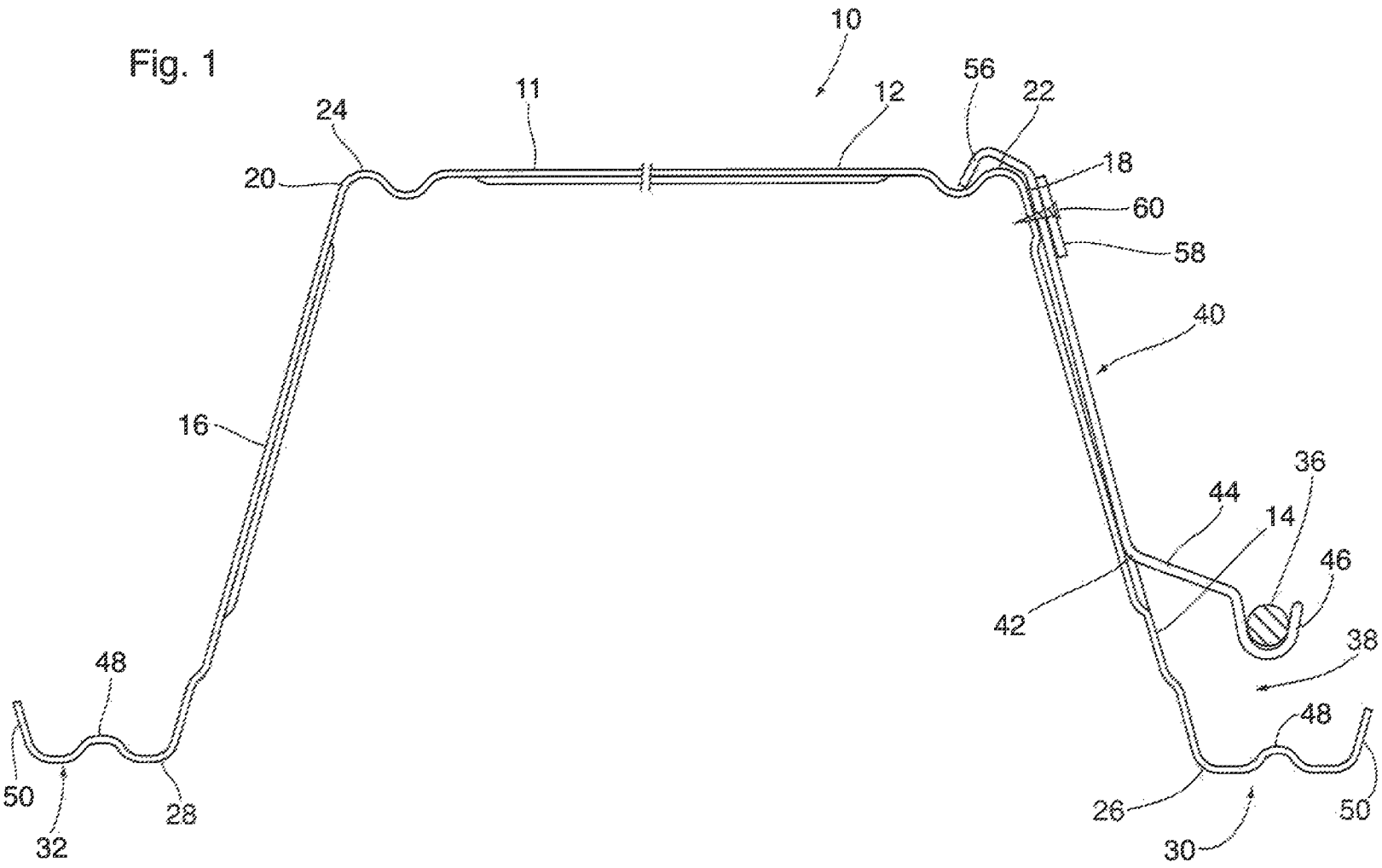
FIG. 1 is a view in cross section of a first preferred embodiment of a floor panel according to the present invention.

The present invention provides a prefabricated floor panel system used in stay in place formwork for pouring concrete floors. The prefabricated floor panel system comprises a top and having walls depending downwardly at an upper lateral edge of the wall from each outermost lateral edge of the top, a lower lateral edge of each wall having a ledge extending outwardly away from the top. A first ledge of one prefabricated floor panel system is capable of overlying another ledge of an adjacent prefabricated floor panel system to allow for the one prefabricated floor panel system to be joined to the adjacent prefabricated floor panel system to form a channel. The first ledge of the prefabricated floor panel system is provided with a reinforcing bar spaced away from the wall and the first ledge of the prefabricated floor panel system, the reinforcing bar being supported by a plurality of a reinforcing bar chairs spaced along the length of the prefabricated panel system. The reinforcing bar chairs are attached to the first ledge or wall such that there are no significant structures projecting from a lower surface of the first ledge. The other ledge of the prefabricated floor panel system is free of interfering structures above the ledge to allow the first ledge of one prefabricated floor panel system to overlie the other ledge of an adjacent prefabricated floor panel system to allow for the one prefabricated floor panel system to be joined to the adjacent prefabricated floor panel system to form a channel.

In one preferred aspect, the present invention provides a floor panel used in stay-in-place formwork for pouring concrete floors where each of the ledges are free of interfering structures on both the upper and lower surfaces. The floor panel comprises a top and having walls depending downwardly at an upper lateral edge of the wall from each outermost lateral edge of the top, a lower lateral edge of each wall having a ledge extending outwardly away from the top, the ledge of one floor panel being capable of overlying the ledge of an adjacent floor panel to allow for the one floor panel to be joined to the adjacent floor panel to form a channel. At least one outermost lateral edge of the floor panel is provided with a reinforcing bar spaced away from the wall and ledge of the floor panel such that there are no interfering structures between the ledge and the reinforcing bar to interfere with the joining of one floor panel to another floor panel by overlying the ledges of the floor panels. The reinforcing bar is supported by a plurality of reinforcing bar chairs being attached to the wall and/or the top of the floor panel and at a lower edge having a leg extending from and spaced away from the wall of the channel to a U-shaped reinforcing bar chair spaced away from the wall and ledge, the reinforcing bar being attached to the reinforcing bar chair. The free ledge of the other outermost lateral edge of the floor panel being capable of overlying the ledge of an adjacent floor panel to allow for the one floor panel to be joined to the adjacent floor panel to form a channel.

Figure 4:
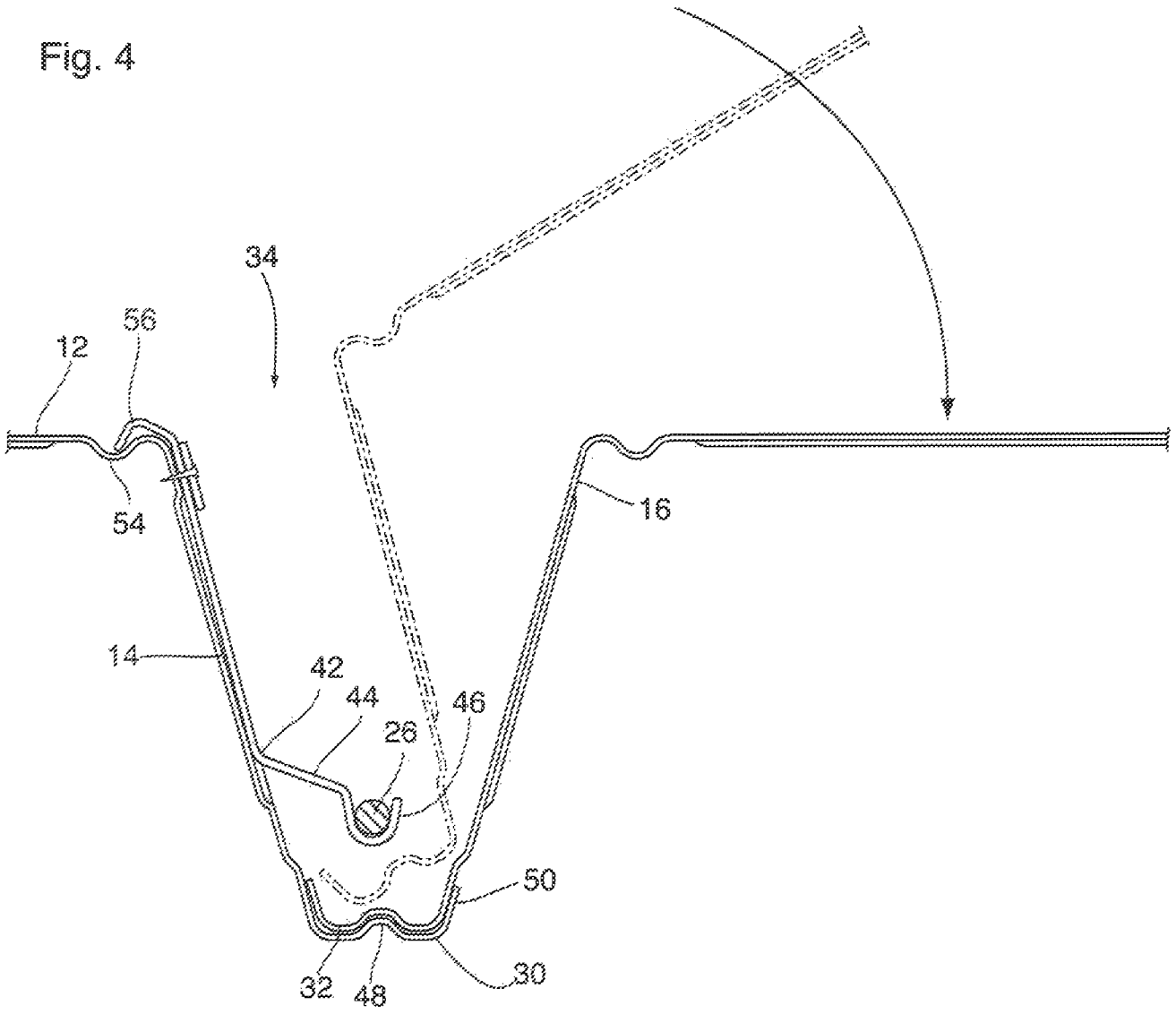
FIG. 4 is a view in cross section of the floor panel system of FIG. 1 as used in construction of a floor.

FIG. 1 illustrates the above preferred embodiment of a prefabricated floor panel system of the present invention used in stay in place formwork for pouring concrete floors generally indicated by the numeral 10. The prefabricated floor panel system 10 has a floor panel 11 with a top 12 and walls 14 and 16 depending downwardly at upper lateral edges 18 and 20 of the walls 14 and 16, respectively, from each outermost lateral edge 22 and 24, respectively, of the top 12. Lower lateral edges 26 and 28 of each wall 14 and 16, respectively, have ledges 30 and 32, respectively, extending outwardly away from the top 12. As shown in FIG. 4, the ledge 32 of one prefabricated floor panel system 10 is capable of overlying the ledge 30 of an adjacent prefabricated floor panel system 10 to allow for the one prefabricated floor panel system 10 to be joined to an adjacent prefabricated floor panel system 10 to form a channel 34.

A reinforcing bar 36 is supported in a position spaced away from outermost wall 14 and ledge 30 such that there are no interfering structures between the ledge 30 and the reinforcing bar 36 as indicated by numeral 38 to interfere with the joining of one prefabricated floor panel system 10 to another adjacent prefabricated floor panel system 10 by overlying the ledge 30 of one prefabricated floor panel system 10 with ledge 32 of the adjacent prefabricated floor panel system 10. As shown in FIGS. 1 to 4 and 9, the reinforcing bar 36 is supported in such position by a plurality of first reinforcing bar chairs 40 attached to the wall 14 and/or the top 12 of floor panel 11 along its length. Each reinforcing bar chair 40 has a lower edge 42 from which a leg 44 extends away from the wall 14 to a U-shaped reinforcing bar saddle 46 spaced away from the wall 14 and ledge 30. The reinforcing bar 36 is attached to the reinforcing bar saddle 46.

In a preferred embodiment, as shown in FIGS. 1 to 4, wall 16 of the prefabricated floor panel system 10 is free of a reinforcing bar. The free ledge 32 of the other outermost lateral edge 24 of the prefabricated floor panel system 10 is capable of overlying the ledge 30 of an adjacent prefabricated floor panel system 10 to allow for the one prefabricated floor panel system 10 to be joined to the adjacent prefabricated floor panel system 10 to form a channel 34, as illustrated in FIG. 4. In such preferred embodiment, adjacent prefabricated floor panel systems 10 will have the same general configuration and can be assembled together in modular fashion.

In an alternate embodiment (not shown), wall 16 of prefabricated floor panel system 10 may be provided with a reinforcing bar 36 similar to the reinforcing bar 36 alongside wall 14. In such an arrangement, the reinforcing bar 36 alongside wall 16 will be suspended from the wall utilizing a plurality of reinforcing bar chairs 40 similar to those attached to wall 14. The reinforcing bar chairs 40 attached to both wall 14 and wall 16 would be sized to provide the two reinforcing bars 36 in the channel 34 either in a side by side relationship or in a vertical arrangement. The configuration of the prefabricated floor panel system to achieve this will be immediately apparent to those of skill in the art.

Figure 2:
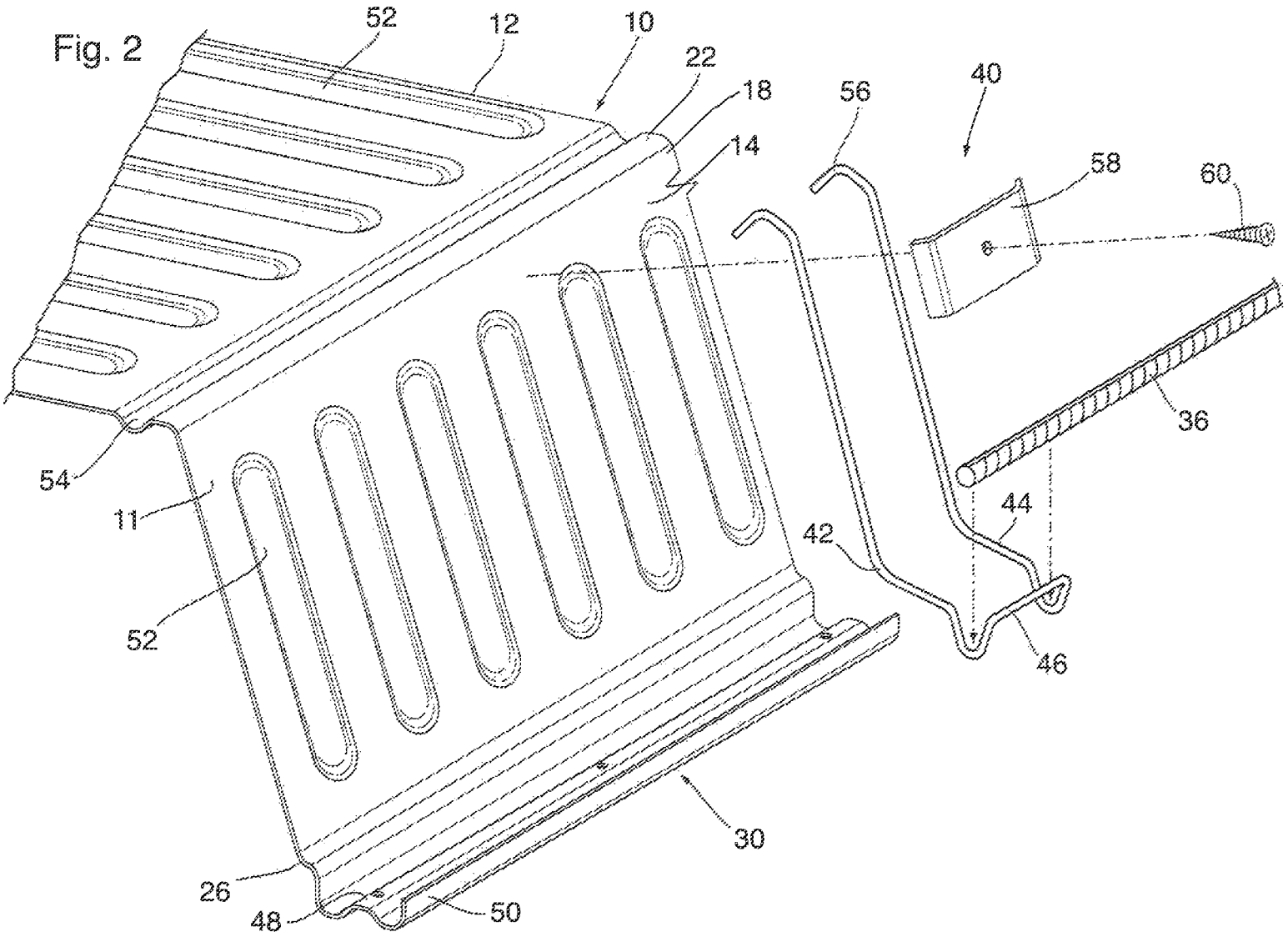
FIG. 2 is a perspective view of a reinforcing bar chair used to suspend the reinforcing bar at one end of the floor panel of FIG. 1.
Figure 3:
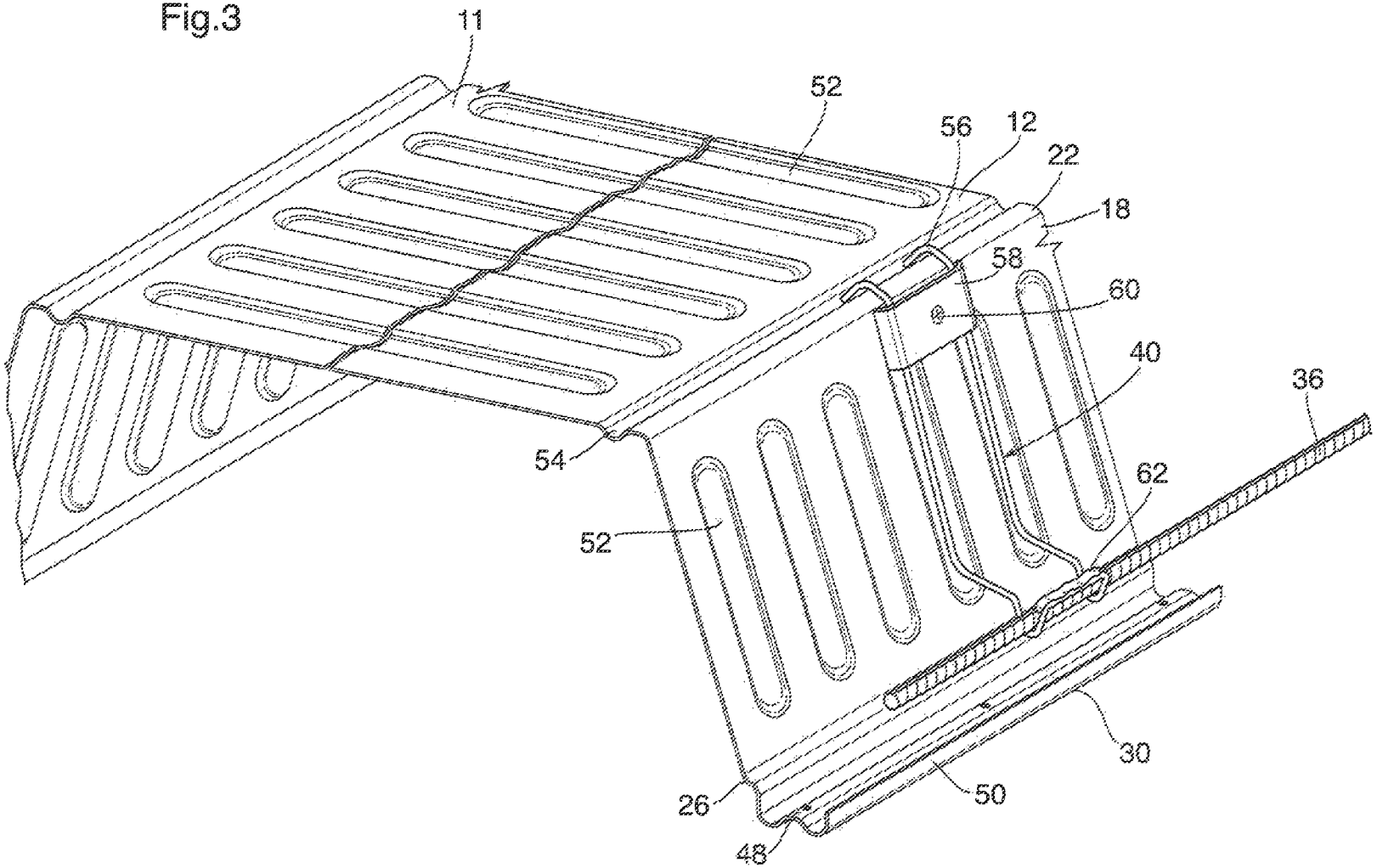
FIG. 3 is a perspective view of the reinforcing bar suspended at the one end of the floor panel of FIG. 1.

As illustrated in FIG. 2, to strengthen the prefabricated floor panel system 10, various reinforcing structures such as indents and ribs are provided in one or more of the walls, top and ledges, preferably in all three. Preferably, the ledges 30 and 32 are provided with one or more longitudinally extending ribs 48 as well as having an upturned outer edge 50. The walls 14 and 16 and top 12 are provided with a plurality of ribs 52 extending across the width of the wall 14 or 16 or top 12, and the top 12 is provided with longitudinally extending ribs 54 adjacent the lateral edges 22 and 24. Preferably, the first reinforcing bar chair 40 is provided with a hook 56 at the top thereof which latches into the longitudinally extending rib 54 of the top 12 of the prefabricated floor panel system 10 to properly space the reinforcing bar 36 away from the wall 14 and ledge 30. Once the reinforcing bar chairs 40 are properly positioned, they are attached to the wall 14 using clamps 58 and suitable fastening means such as screws 60. The reinforcing bar 36 is then placed in the U-shaped reinforcing bar saddle 46 and attached thereto by tie wire wrapping or welding. Preferably, to provide a more secure and permanent connection, especially for transport to the building site, the reinforcing bar 36 is attached to the U-shaped reinforcing bar saddle 46 by welding 62.

Figure 11:
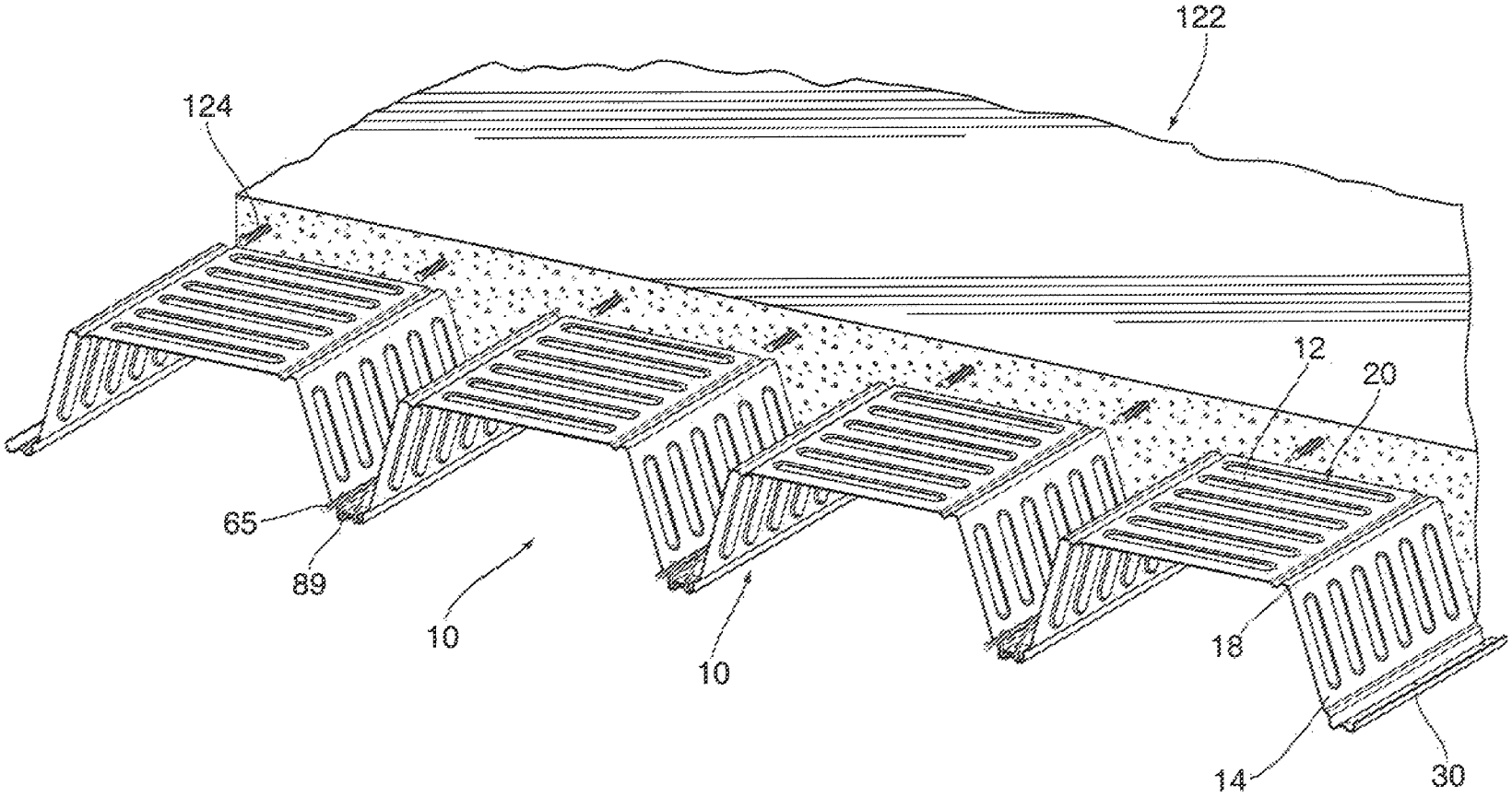
FIG. 11 illustrates an installed floor using the floor panel system of FIG. 9.

The prefabricated floor panel system 10 will typically have a width of 6 to 8 feet and a length of 20 to 30 feet. In order to provide adequate support for the formwork as the floor is being poured as well as the poured concrete floor when it cures, it is preferred if the prefabricated floor panel system 10 is provided with longitudinally extending internal channels 64 every two feet or so. One way this can be accomplished is to form the floor panel 11 in one piece. This can be accomplished by roll forming a suitably sized steel sheet or roll into the shape of the floor panel 11. Alternatively, the floor panel 11 may be formed by molding a suitable plastic material having the strength required to support the poured concrete floor while it cures without sagging. Preferably, reinforcing bar 65 is installed in channels 64. Such a prefabricated floor panel system 10 would preferably be as shown in FIGS. 9 and 11 described below.

Figure 5:
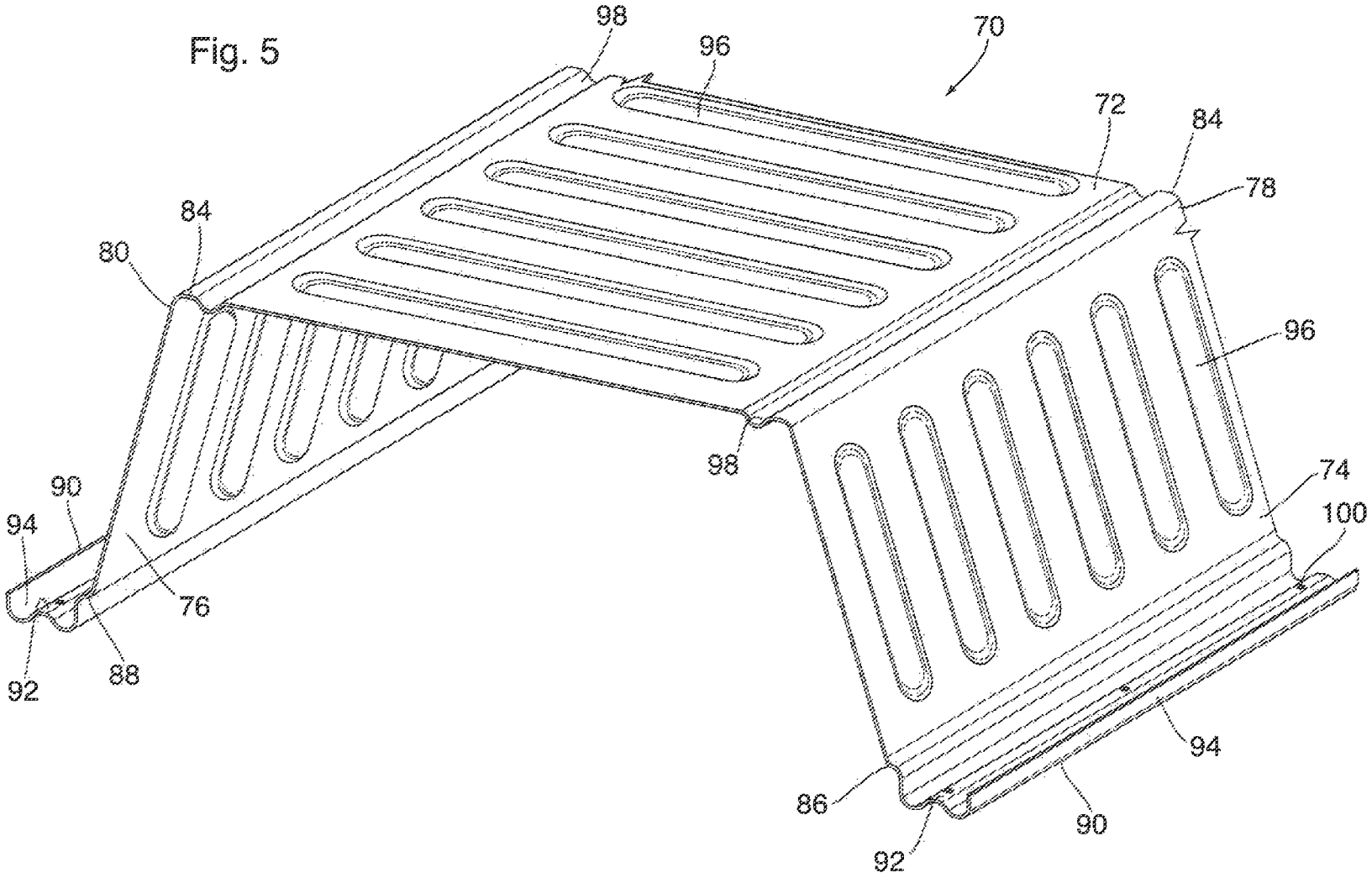
FIG. 5 is a perspective view of a floor panel section used to construct a floor panel in accordance with a second preferred embodiment of the present invention.

Another option for constructing floor panel 11 is to connect multiple individual floor panel segments 70 into the desired prefabricated floor panel system 10 width. For example, a plurality of panel segments 70, as shown in FIG. 5, each about two feet wide, could be joined together to form the prefabricated floor panel system 10 as illustrated in FIGS. 9 and 11. Panel segment 70 has a top 72 and walls 74 and 76 depending downwardly at an upper longitudinal lateral edge 78 and 80 of the wall 74 and 76 respectively from each lateral edge 82 of the top 72. A lower lateral edge 86 and 88 of each wall 74 and 76, respectively, has a ledge 90 extending outwardly away from the top 72, the ledge 90 of one panel segment 70 capable of overlying the ledge 90 of an adjacent panel segment 70 to allow for the one panel segment 70 to be joined to an adjacent panel segment 70. To strengthen the panel segment 70, various indents and ribs are provided in the walls 74 and 76, top 72 and ledges 90. Ledges 90 are provided with one or more longitudinally extending ribs 92 as well as having an upturned outer edge 94. The walls 74 and 76 and top 72 are provided with a plurality of ribs 96 extending across the width of the wall 74 and 76 or top 72. The top 72 is provided with longitudinally extending ribs 98 adjacent the lateral edge 82. The ledge 90 is also provided with pre-punched holes 100 evenly spaced along the ledge 90 to accept suitable fastening means to join the overlying ledges 90 of one panel segment 70 to the adjacent panel segment 70, to construct the floor panel 11.

Figure 6:
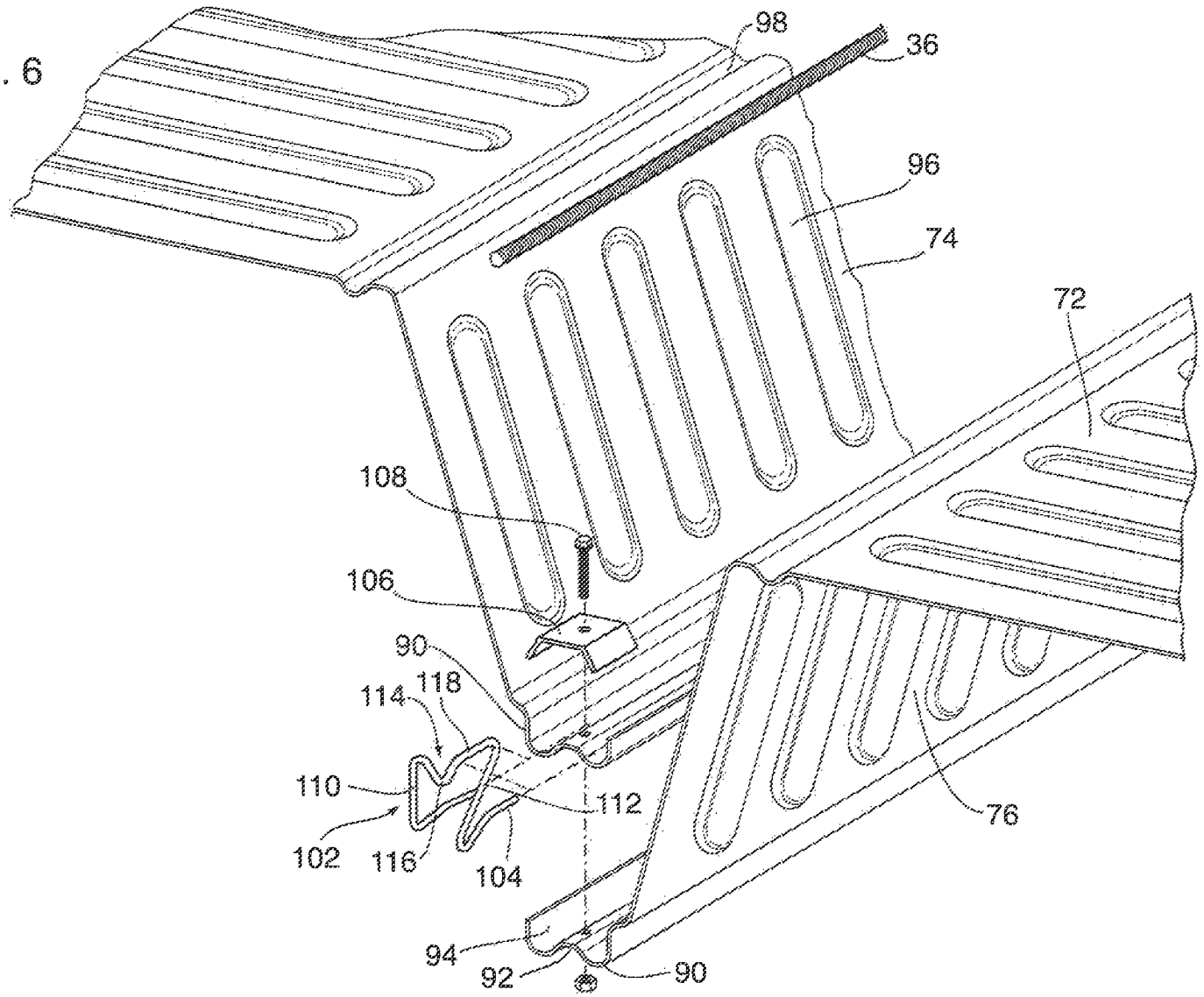
FIG. 6 is an exploded perspective view illustrating the joining of adjacent floor panels into the floor panel according to the second embodiment and installation of the reinforcing bar.
Figures 7, 8:
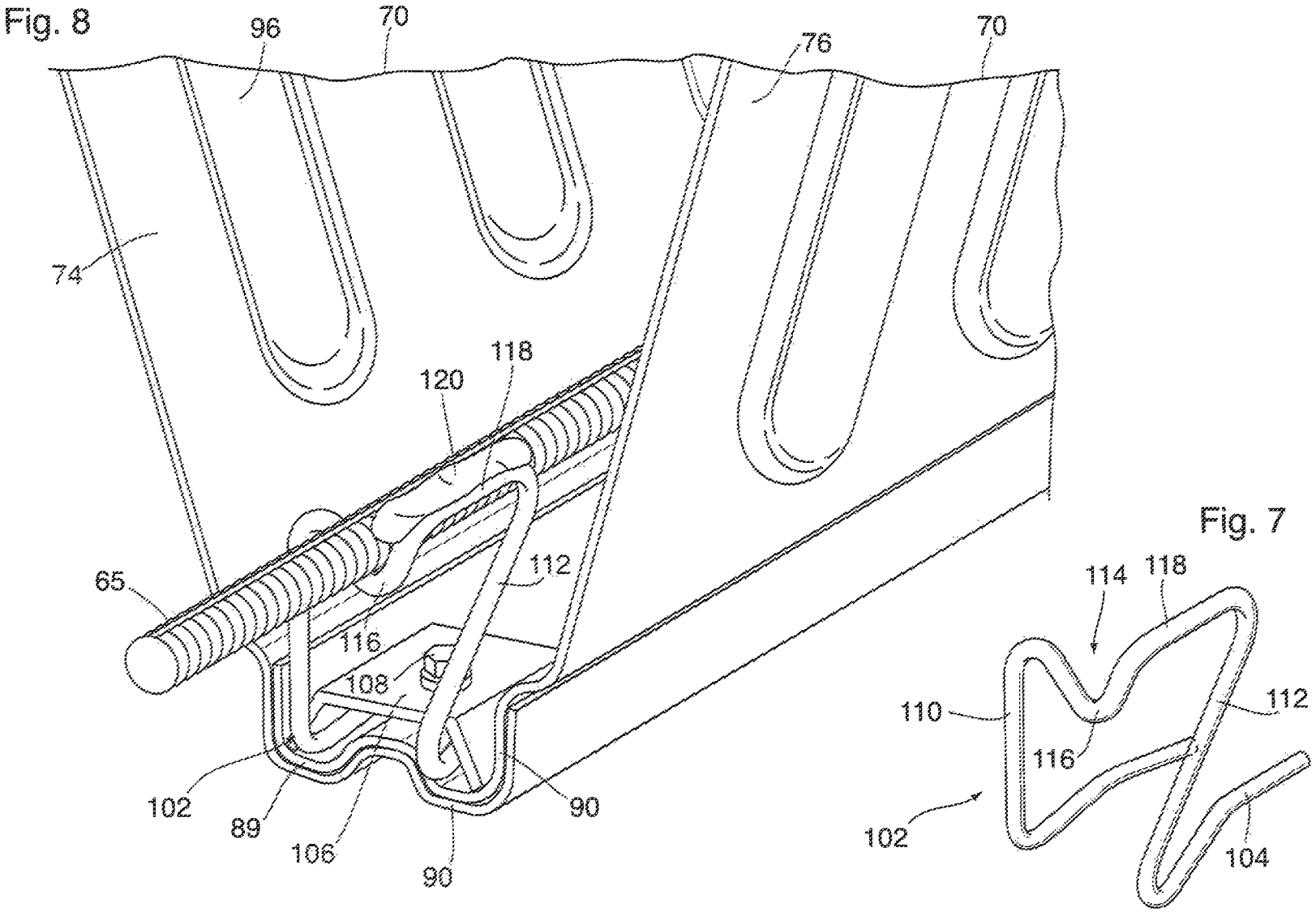
FIG. 7 is a perspective view of a preferred embodiment of a reinforcing bar chair used in the channel formed by the joined floor panels of the second embodiment.
FIG. 8 is a perspective view of the joined floor panels and installed reinforcing bar.

As noted above, preferably reinforcing bar 65 is installed in channels 64. Although any suitable method could be used, one convenient structure for doing so (shown in FIG. 9A) would be to utilize reinforcing bar chairs 40 in the same manner as described above. Alternatively, second reinforcing bar chairs 102, as shown in FIGS. 6 to 8, could be used. As shown therein, second reinforcing bar chairs 102 are attached to the base 89 of channel 64. In the specific embodiment shown in FIGS. 6 to 8, base 89 is formed by the overlapped ledges 90 when adjacent floor panel segments 70 are being joined together. As illustrated in FIGS. 6 to 8 the second reinforcing bar chair 102 comprises feet 104 which are contained within the clamps 106 which are utilized to join the two ledges 90 together using suitable fastening means 108 attached to the pre-punched holes 100. Extending upwardly from the feet 104 of the second reinforcing bar chair 102 are legs—preferably a first leg 110 which is generally perpendicular to feet 104 and a second leg 112 which extends rearwardly relative to the first leg 110. Between the top of the first leg 110 and second leg 112, there is a saddle 114 provided to accept the reinforcing bar 65. The saddle 114 includes a U-shaped support 116 connected to and extending generally perpendicularly from the top of the first leg 110 and connected to the second leg 112 by a laterally extending upper arm 118 which will lie against the reinforcing bar 65 when the reinforcing bar 65 is in the saddle 114. Once the reinforcing bar 65 is placed within the saddle 114, then the connection to the reinforcing bar 65 and saddle 114 is completed by tie wire wrapping or more preferably welding 120 to the upper arm 118 as illustrated in FIG. 8.

Figure 9:
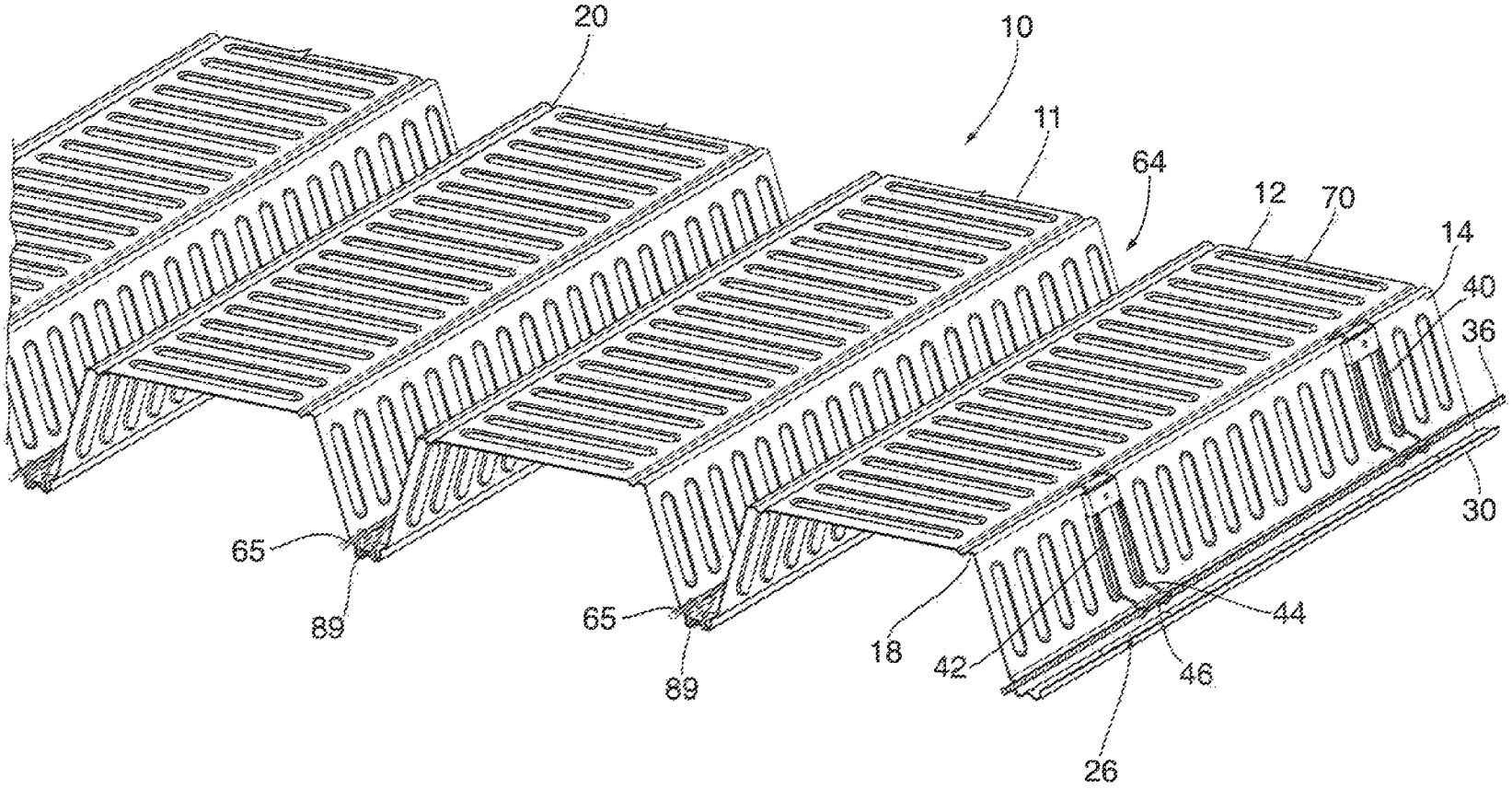
FIG. 9 is a perspective view of a floor panel according to the second embodiment.

An assembled prefabricated floor panel system 10 according to this embodiment of the present invention utilizing configuration of FIGS. 5 to 8 is illustrated in FIG. 9 where four individual panel segments 70 have been joined together to form an eight-foot-wide prefabricated floor panel system 10 according to the present invention. The outermost lateral edge 18 of the prefabricated floor panel system 10 is provided with a reinforcing bar 36 spaced away from the wall 14 and ledge 30 of the prefabricated floor panel system 10 such that there are no interfering structures between the ledge 30 and the reinforcing bar 36 as indicated by numeral 26 to interfere with the joining of one prefabricated floor panel system 10 to another prefabricated floor panel system 10 by overlying the ledges 30 and 32 of the prefabricated floor panel systems 10. The reinforcing bar 36 is supported by a plurality of reinforcing bar chairs 40 being attached to the wall 14 and/or the top 12 of the floor panel 10 and at a lower edge 42 having a leg 44 extending from and spaced away from the wall 14 of the floor panel 10 to a U shaped reinforcing bar saddle 46 spaced away from the wall 14 and ledge 30, the reinforcing bar 36 being attached to the reinforcing bar saddle 46. The outermost lateral edge 20 of the prefabricated floor panel system 10 has only ledge 32 and no reinforcing bar is present.

Figure 10:
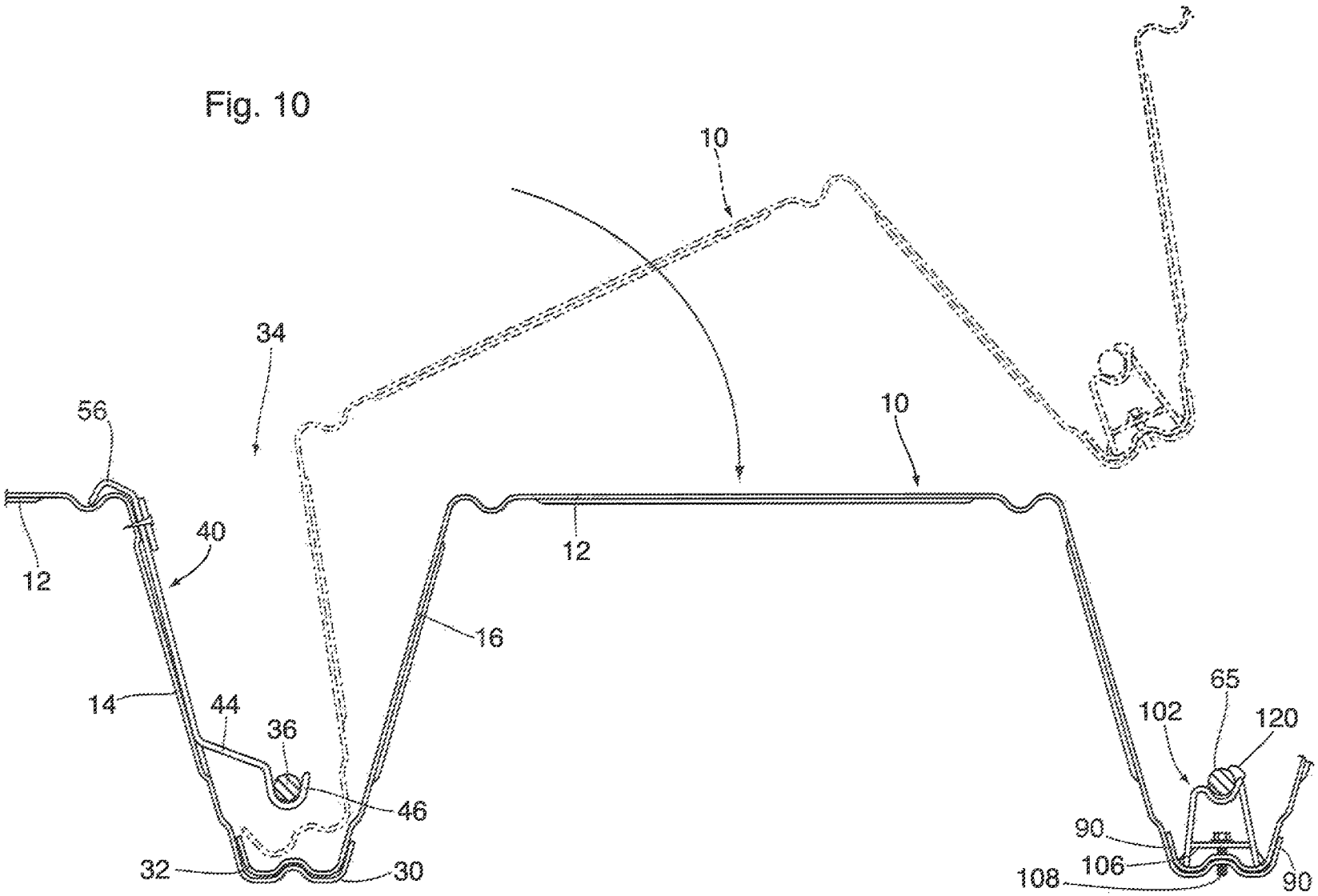
FIG. 10 illustrates the process of joining of one floor panel according to FIG. 9 to an adjacent floor panel according to FIG. 9.

As illustrated in FIG. 10, using this configuration of the prefabricated floor panel system 10, a first prefabricated floor panel system 10 is joined to an adjacent second prefabricated floor panel system 10 by rotating the first prefabricated floor panel system 10 to be joined to the second prefabricated floor panel system 10 already installed to allow the ledge 32 of the first prefabricated floor panel system 10 to overlie the ledge 30 of the second prefabricated floor panel system 10. Once this is done, the two ledges 30 and 32 are connected together by suitable fastening means.

FIG. 11 illustrates a typical floor 122 poured utilizing the prefabricated floor panel system 10 of the present invention. Once the prefabricated floor panel systems 10 are placed to tie into the support structure and are properly supported, the mesh 124 to ensure the unity of the concrete floor 122 is installed spaced above the prefabricated floor panel system 10 to be embedded within the concrete floor 122 and then the concrete floor is poured in the usual manner. Once the concrete floor 122 cures, then the process is repeated for the next floor.

As described above, one feature of the present invention is to reduce the time required to construct each floor of a mid- or high-rise building. Another is improved safety. These are accomplished in part by providing prefabricated floor panel systems 10 that can be easily installed and connected together in a rapid manner to provide the formwork required to pour the concrete floor. In addition as the prefabricated floor panel systems 10 include all of the necessary reinforcing bars they do not have to be installed in situ, thus, reducing the time and labor to have the formwork set up for the pouring of the concrete and improving safety by having less work to do at height. One way the reduction in time of construction is accomplished is to prefabricate the prefabricated floor panel systems 10 as described above in a factory or assembly facility and then transport the prefabricated floor panel systems 10 to the construction site. Alternatively, in some cases, it may be desirable to deliver the components for the prefabricated floor panel system 10 to a ground level assembly area on the construction site where the prefabricated floor panel systems 10 can be assembled and then lifted by crane for convenient installation at height.

Figure 12:
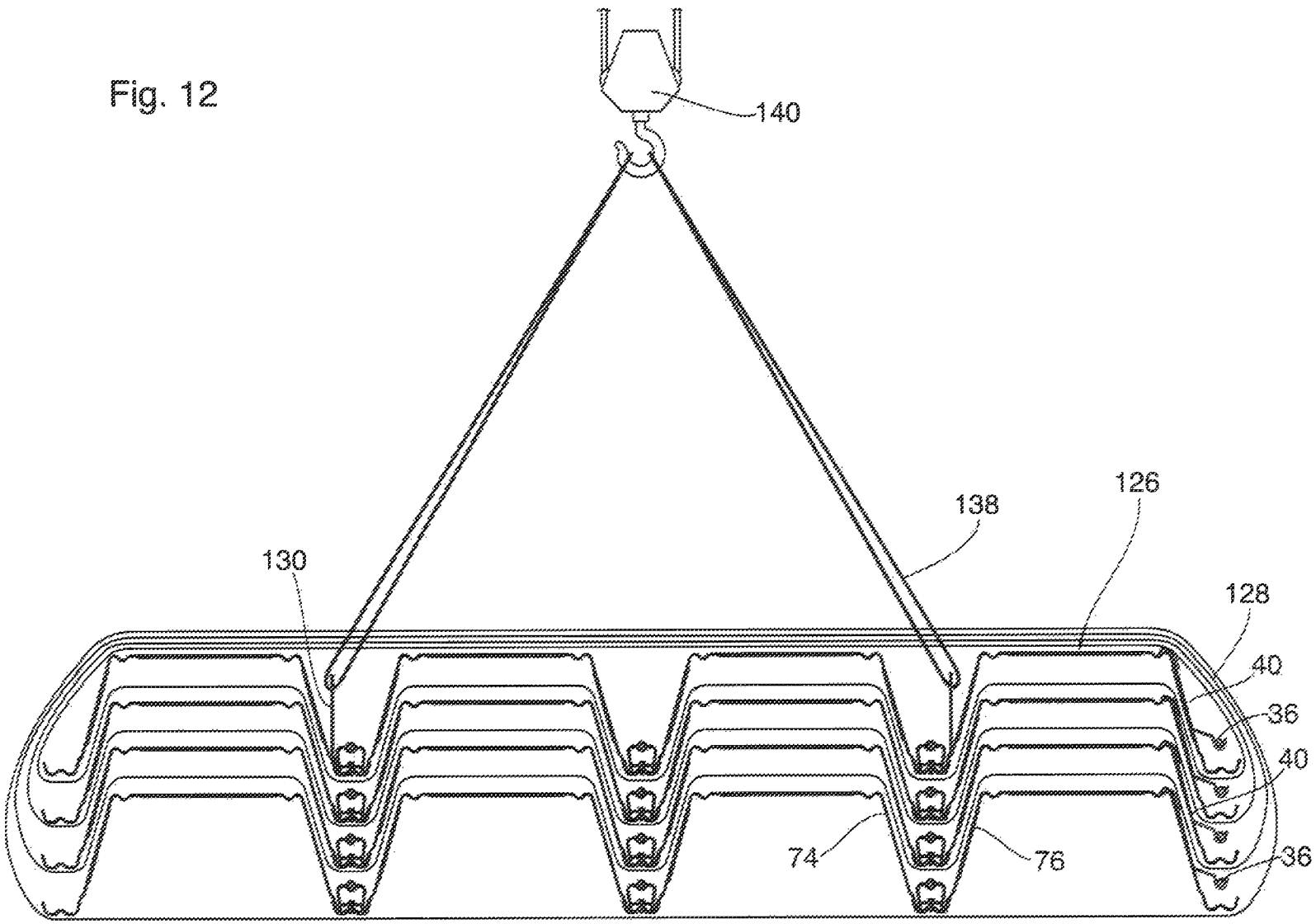
FIG. 12 is a perspective view of the installation of a first lifting support of a preferred embodiment of the present invention.

As illustrated in FIG. 12, once the prefabricated floor panel systems 10 are fabricated they can be bundled together in bundles 126, such as in bundles 126 of three or more and strapped together using straps 128.

In order to allow for the bundles 126 and individual prefabricated floor panel systems 10 to be moved from the factory to the transport vehicle and from the transport vehicle to the building under construction by lifting devices such as cranes, suitable lifting structures 130 are included in the prefabricated floor panel systems 10. Preferred embodiments of the lifting structures 130 are illustrated in FIGS. 12 to 16. Preferably, the lifting structures 130 are provided in the internal channels 64 such that they support the prefabricated floor panel system 10. For example, as illustrated in FIG. 12, a prefabricated floor panel system 10 having three internal channels 64 would be provided with lifting structures 130 in the first and third internal channels 64. A plurality of lifting structures 130 would be provided spaced along the length of the internal channels 64 to provide for proper support of the bundles 126 of the prefabricated floor panel systems 10 while being lifted by the crane.

Figure 13:
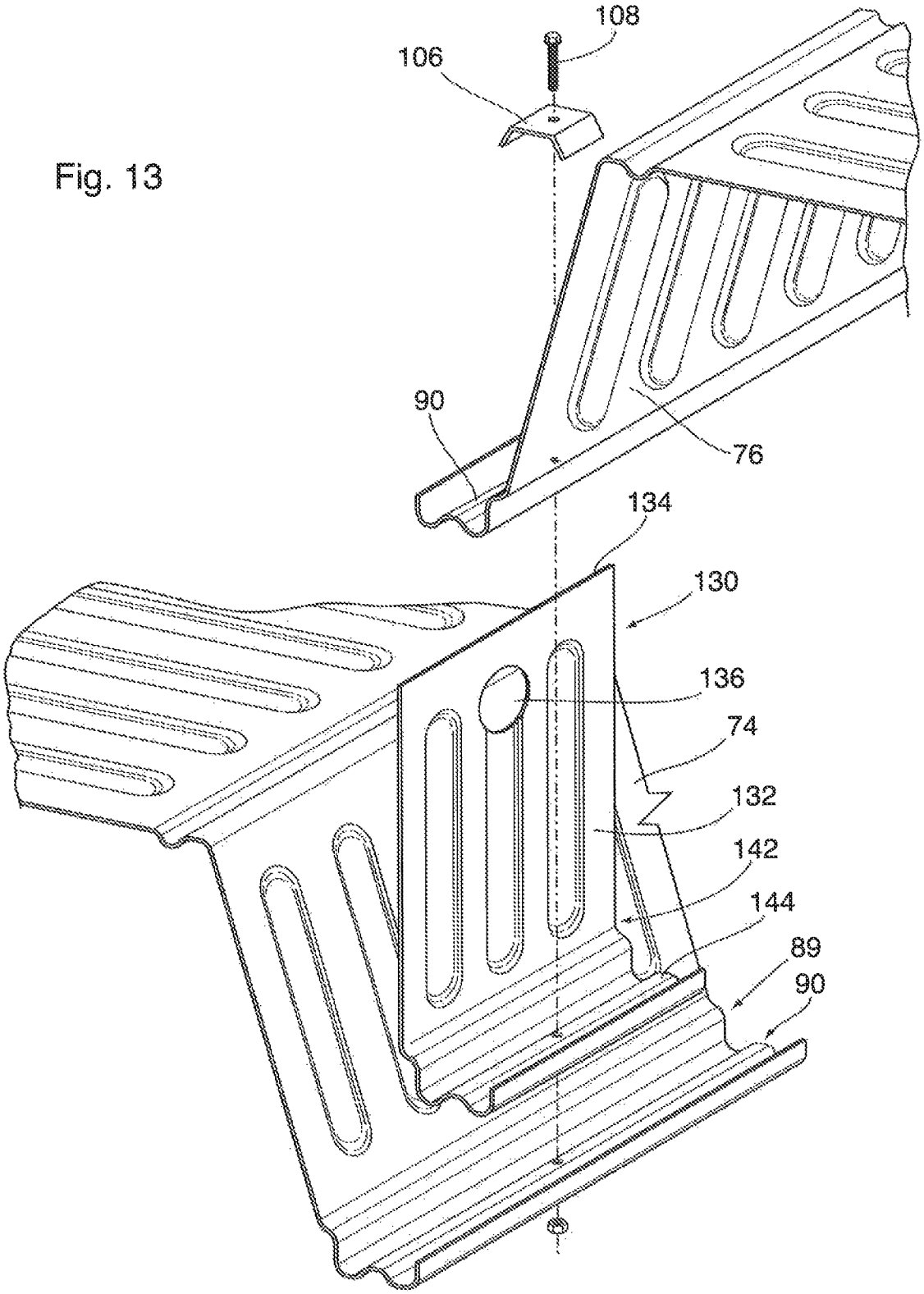
FIG. 13 is a perspective view of the installed lifting support of FIG. 12.
Figure 14:
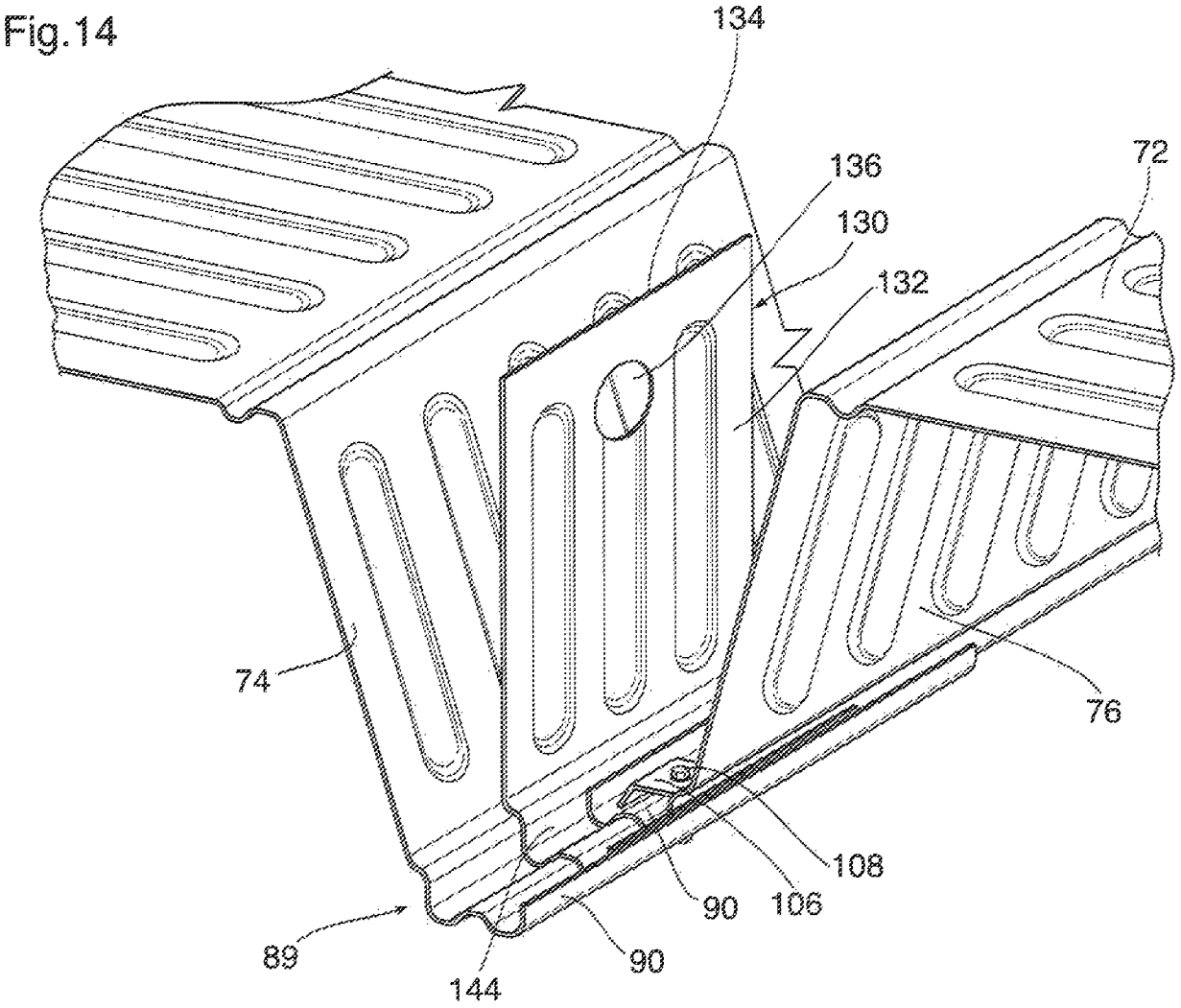
FIG. 14 is a perspective view illustrating the use of a second preferred embodiment of the lifting support of the present invention.

One preferred embodiment of a lifting structure 130 of the present invention is illustrated in FIGS. 12 to 14. The lifting structure 130 of this embodiment has a profile similar to that of the wall 74 and base 89, in the illustrated embodiment formed by ledges 90, of the internal channel 64 of the prefabricated floor panel system 10. Preferably the lifting structure 130 has a wall 132 of a height less than the wall 74 of the prefabricated floor panel system 10. The top of the wall 132 of the lifting structure 130 is a relatively straight edge 134 and the wall 132 of the lifting structure 130 is provided with a hole 136 adjacent to the top edge 134 to accept the load support means 138 of the lifting device 140 such as a hook or strap of a crane. The hole 136 is spaced a sufficient distance below the top edge 134 of the lifting structure 130 to allow for the required strength to allow the load support means 138 to support the bundles 126 of the prefabricated floor panel systems 10 during lifting of the bundle 126 of the prefabricated floor panel systems 10 without deformation of the lifting structure 130. The lower edge 142 of the lifting structure 130 is provided with a ledge 144 extending outwardly and having the same profile as the base 89, such as ledge 90, of the internal channel 64. This allows the lifting structure 130 to be easily attached to the ledge 90 present at the bottom of the internal channel 64 of the prefabricated floor panel system 10. The lifting structure 130 may be attached to the top of the ledge 90 of the channel 64 using the same clamps 106 and fastening means 108 as are used to hold the second reinforcing bar chair 102. Preferably when fabricating the prefabricated floor panel system 10 with panel segments 70, the ledge 144 of the lifting structure 130 is sandwiched between the ledges 90 of the two adjacent panel segments 70 as illustrated in FIGS. 13 and 14.

It is preferred that the angle between the wall 132 and ledge 144 of the lifting structure 130 be different from the angle between the wall 74 and ledge 90 of the internal channel 64 in order to space the wall 132 of the lifting structure 130 away from the wall 74 of the channel 64 to allow the load support means 138 to engage the hole 136 of the lifting structure 130. As illustrated in FIGS. 13 and 14, it is preferred if the angle between the wall 132 and ledge 144 of the lifting structure 130 is less than the angle between the wall 74 and the ledge 90 of the internal channel 64 by preferably making the former angle approximately perpendicular and the latter somewhat obtuse.

Figure 15:
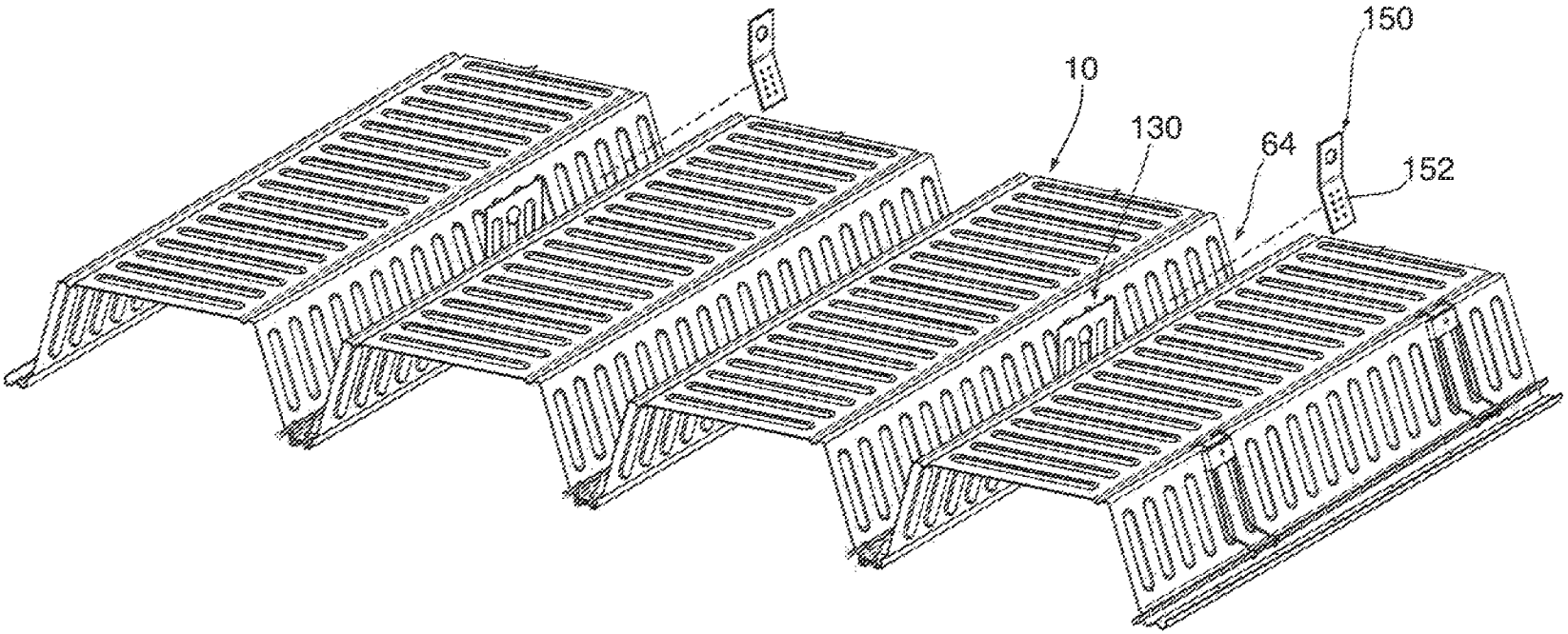
FIG. 15 is a detail perspective view of the installation of the lifting support of FIG. 14.
Figure 16:
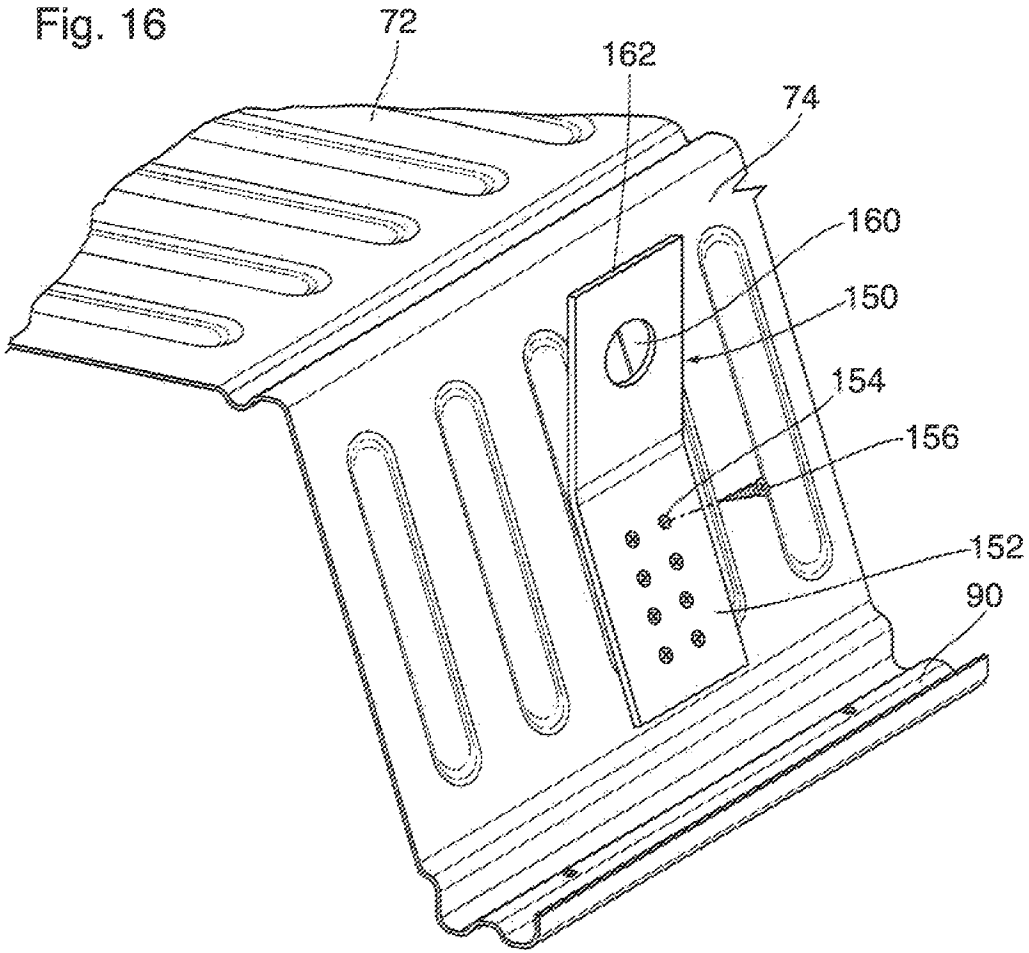
FIG. 16 illustrates the lifting of a bundle of floor panel according to FIG. 9 using the lifting supports of FIG. 12 or FIG. 15.
Figure 17:
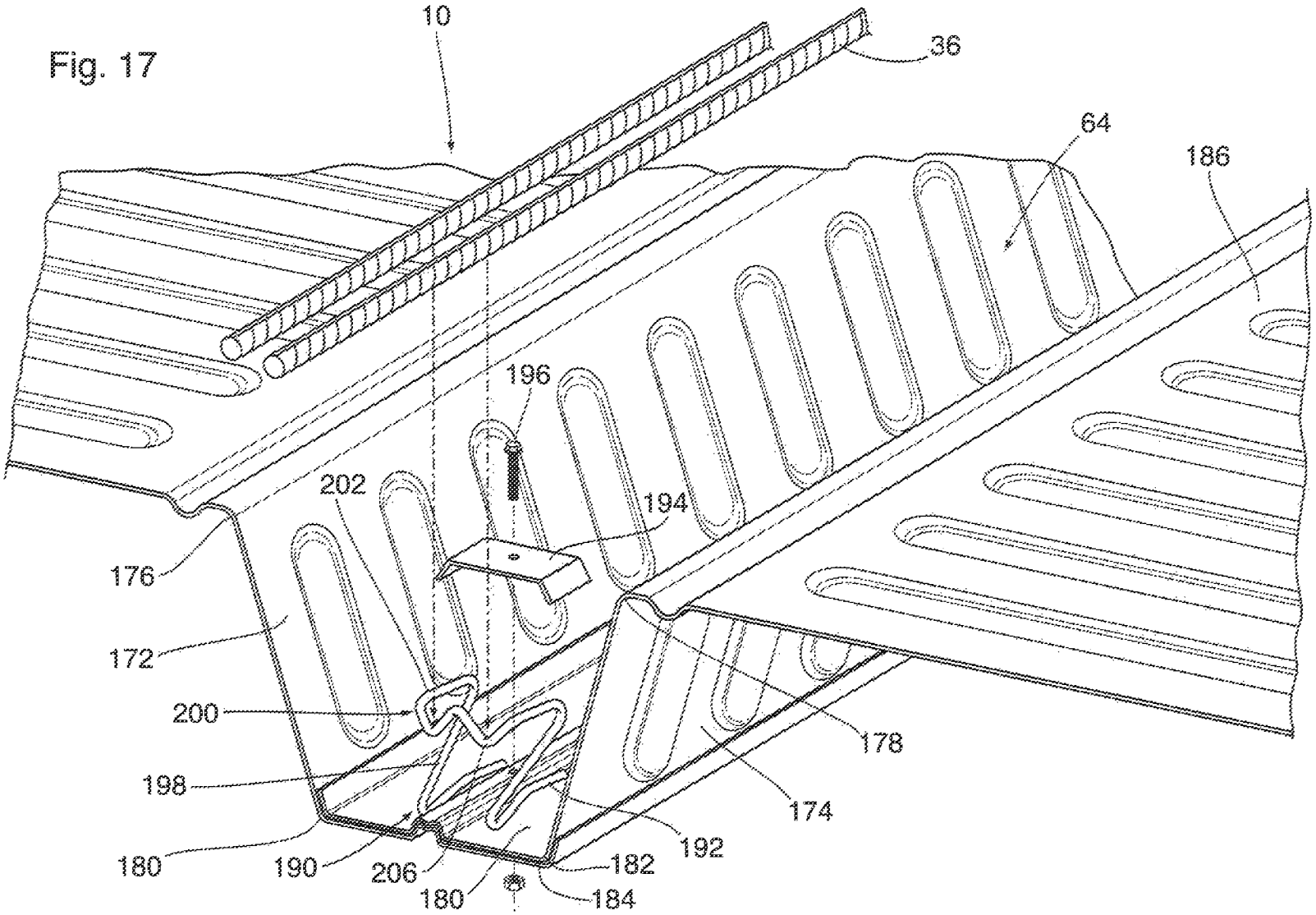
FIG. 17 illustrates floor of the present invention having shorter but wider channels.

A second embodiment of a lifting structure of the present invention is illustrated in FIGS. 15 and 16 generally indicated by the numeral 150. This lifting structure 150 is adapted to attach only directly to the wall 74 of the internal channel 64 and does not engage the ledge 90 of the internal channel 64. This lifting structure 150 is of particular use where it may be difficult to directly engage the ledge 90 of the internal channel 64. This lifting structure 150 may also be of use with the embodiment of the prefabricated floor panel system 10 illustrated in FIGS. 17 to 19 and described herein below.

This lifting structure 150 has a lower generally planar region 152 for overlying and being attached to the wall 74 of the internal channel 64. As illustrated in the Figures, the lower planar region 152 is provided with a plurality of holes 154 to accept a fastening means 156 to fasten the lifting structure 150 to the wall 74 of the internal channel 64. The lifting structure 150 has an upper planar region 158 extending angularly away from the lower planar region 152 such that the upper planar region 158 is spaced away from the wall 74 of the internal channel 64. The upper planar region 158 is provided with a hole 160 to accept the load supporting means 138, the hole 160 being spaced away from a top edge 162 of the upper planar region 158 a sufficient distance to allow for the required strength to allow the load supporting means 138 to lift the bundles 126 of the prefabricated floor panel systems 10 without deformation of the lifting structure 150.

A second embodiment of a prefabricated floor panel system 10 of the present invention is illustrated in FIGS. 17 to 20. This embodiment of the prefabricated floor panel system 10 differs from the first embodiment in the shape of the channels 34 and 64. The channels 34 and 64 of this embodiment are lower in height and wider at the bottom than those of the first embodiment. This is achieved by providing walls 172 and 174 having a lower width between the upper 176 and 178 and lower 180 and 182 lateral edges respectively than the first embodiment. This embodiment also has a ledge 184 having a greater width than the first embodiment extending from the lower lateral edges 180 and 182 of the walls 172 and 174. All other features of the top 186, walls 172 and 174 and ledges 184 of this embodiment of the prefabricated floor panel system 10 are similar to that of the first embodiment. The height of the first reinforcing bar chairs 40 to support the reinforcing bar 36 spaced away from the wall and ledge are adjusted to maintain the required spacing.

Figure 18:
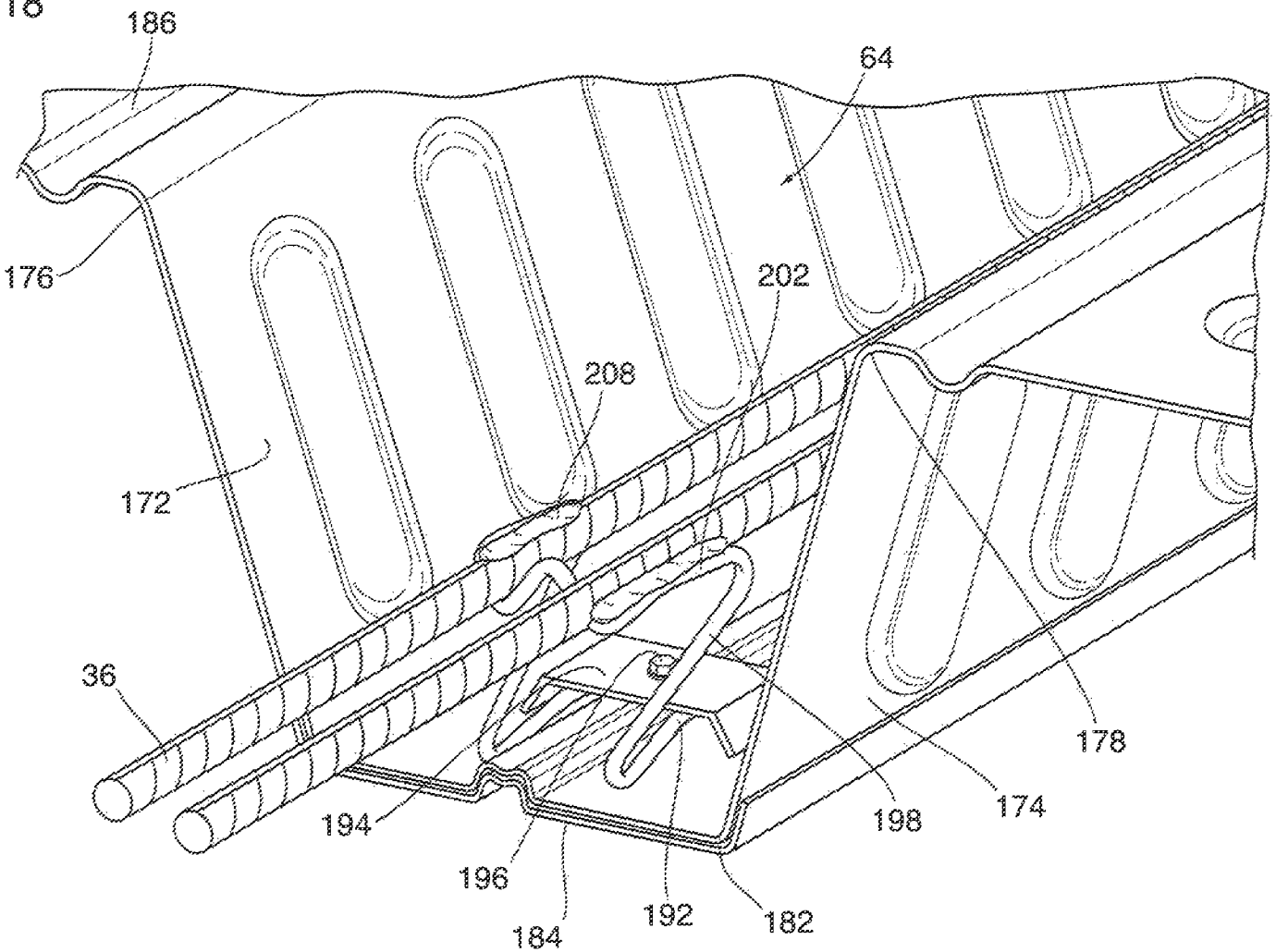
FIG. 18 illustrates the joined floor panels of the floor panel of FIG. 17.
Figure 19:
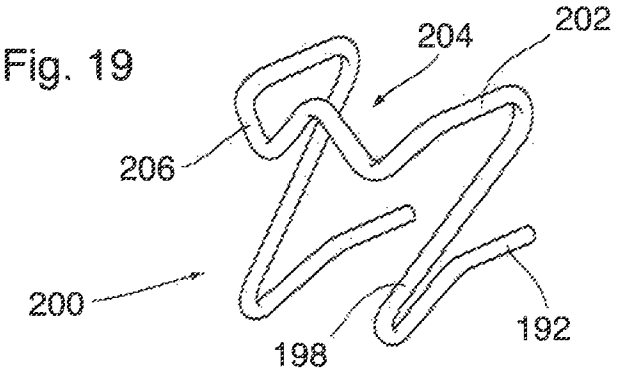
FIG. 19 illustrates an embodiment of a reinforcing bar chair for use in the floor panel of FIG. 17.

While this embodiment of the prefabricated floor panel system 10 could utilize the second reinforcing bar chair 102 of the first embodiment illustrated in FIGS. 6 to 8 and described above, in order to take advantage of the increased width of the bottom of the channels 64, a second reinforcing bar chair 190 capable of supporting more than one reinforcing bar 36 is preferred. One embodiment of such a second reinforcing bar chair 190 is illustrated is FIGS. 17 to 20, the second reinforcing bar chair 190 being attachable to the overlapped ledges 184 when the overlapped ledges 184 are being joined together. As illustrated in the figures, the second reinforcing bar chair 190 comprises two feet 192 which are contained within the clamps 194 which are utilized to join the two ledges 184 together using suitable fastening means 196. Extending upwardly and rearwardly from the two feet 192 of the second reinforcing bar chair 190 are two legs 198. Between the top of the two legs 198 there is a saddle 200 provided to accept the more than one reinforcing bar 36. The saddle 200 includes laterally extending upper arms 202 extending from the top of the legs 198 which will lie against the reinforcing bar 36 when the reinforcing bar 36 is in the saddle 200. Between the laterally extending arms 202 there is a bridging member 204 having sufficient U-shaped supports 206 to support the number of reinforcing bars 36 to be installed. Once the reinforcing bars 36 are placed within the saddle 200 then the connection between the reinforcing bar 36 and saddle is 200 completed by tie wire wrapping or more preferably welding 208 as illustrated in FIG. 18.

Figure 20:
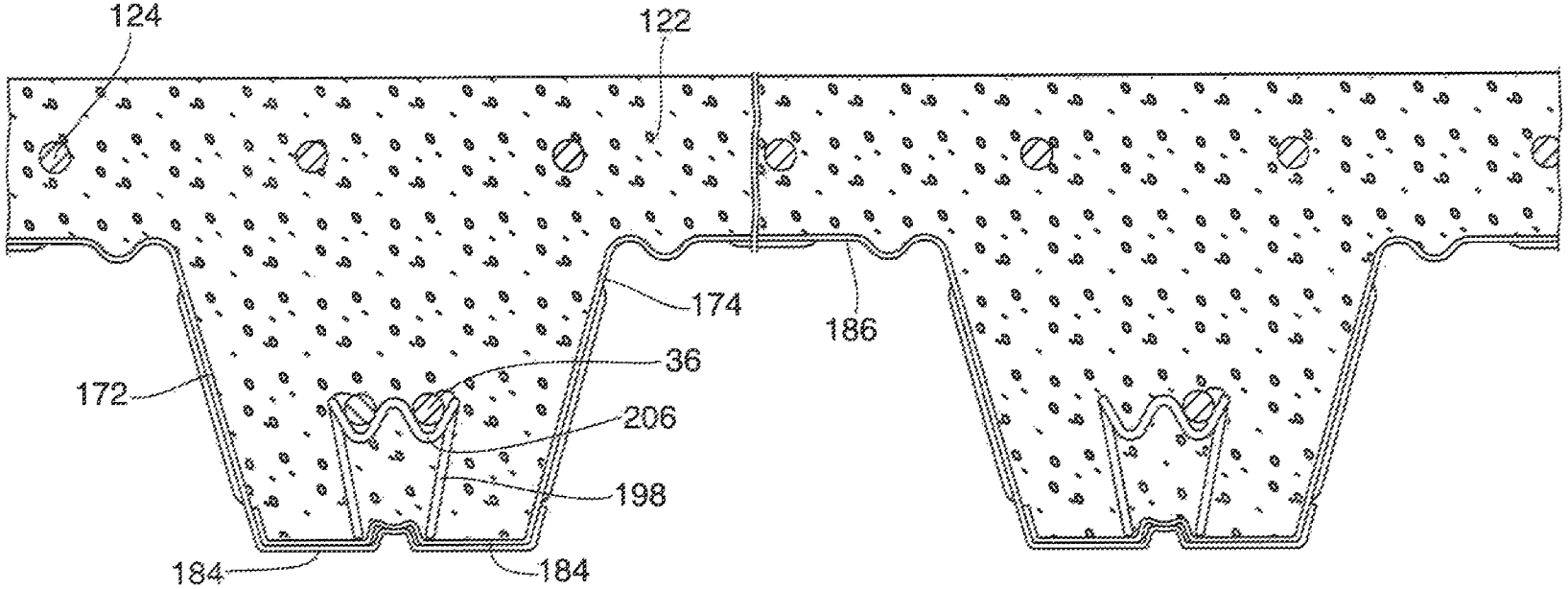
FIG. 20 illustrates an installed floor using the floor panel of FIG. 17.

The embodiment of the second reinforcing bar chair 190 as illustrated in FIGS. 17 to 20 is capable of accommodating two reinforcing bars 36. However depending upon the situation and the floor load it may be only necessary to install one reinforcing bar 36. Such a situation is illustrated in FIG. 20 which illustrates a concrete floor poured using this embodiment of the prefabricated floor panel system 10 with other details similar to those shown in FIG. 11.

Figure 21:
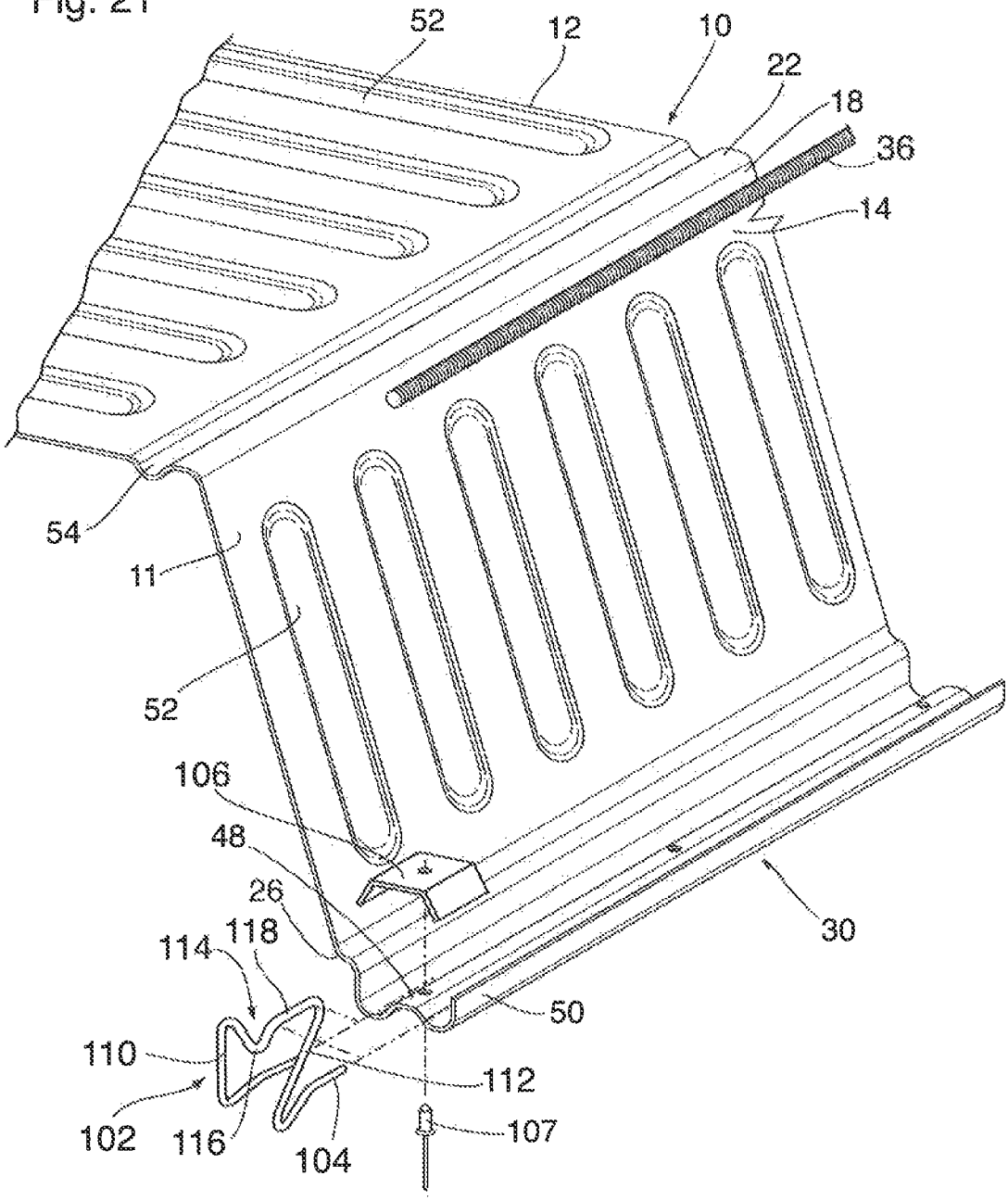
FIG. 21 is a view in cross section of a further preferred embodiment of a floor panel according to the present invention.
Figure 22:
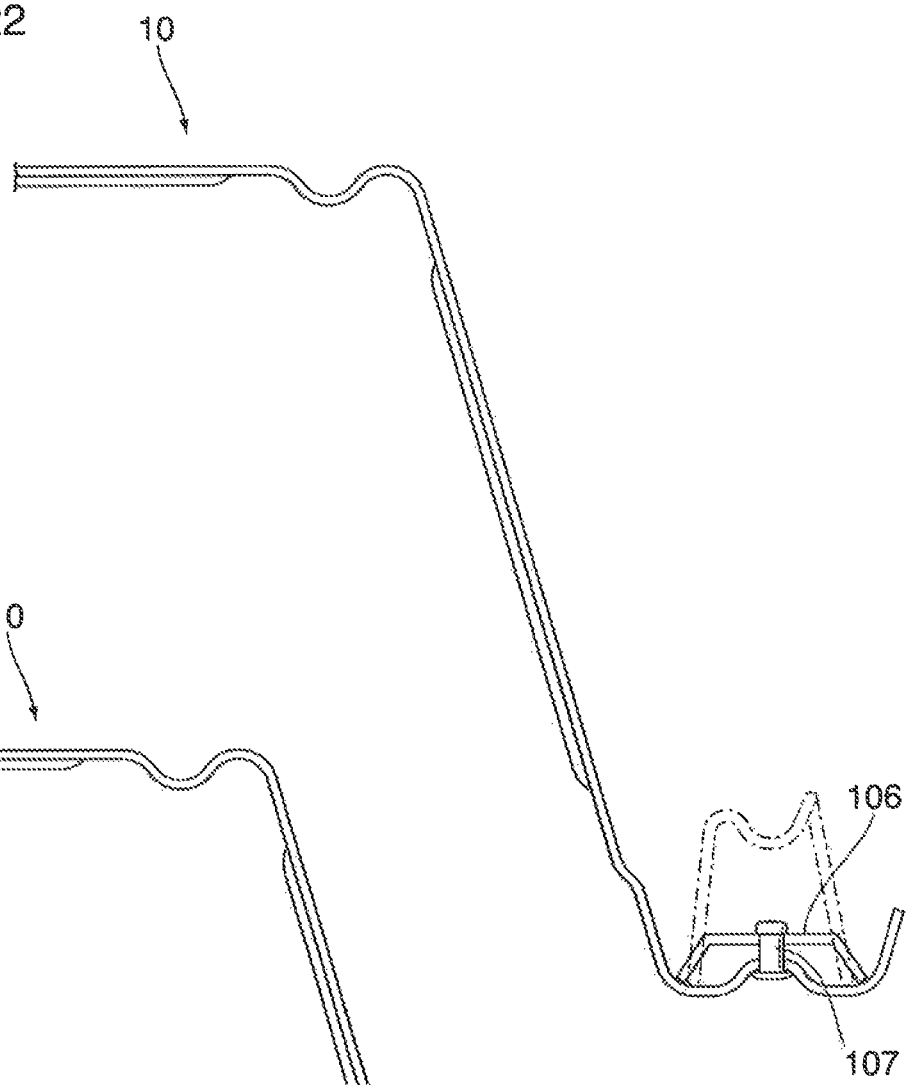
FIG. 22 is a perspective view of a floor panel according to FIG. 21.
Figure 23:
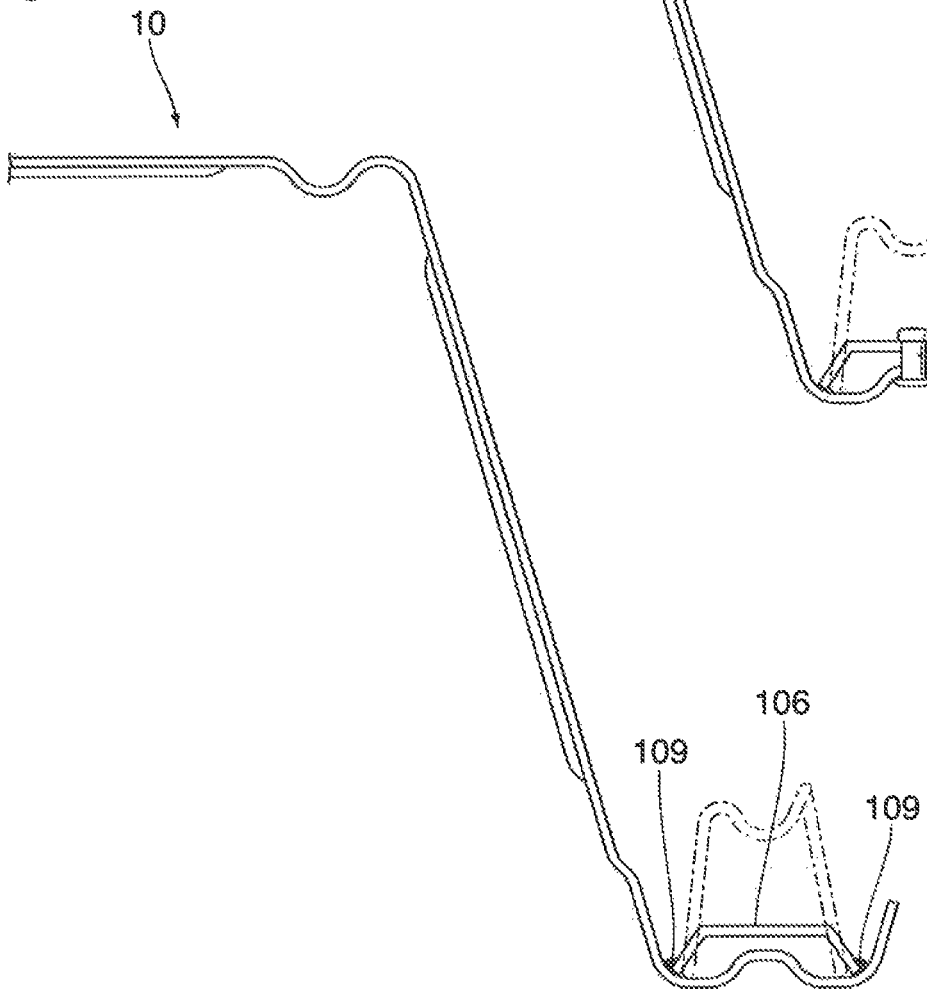
FIG. 23 is a perspective view of an alternative attachment of the reinforcing bar to the ledge of the panel of FIG. 21.

A third embodiment of a prefabricated floor panel system 10 of the present invention is illustrated in FIGS. 21 to 23. This embodiment of the prefabricated floor panel system is similar in shape to the first embodiment. Thus, the shape of the channels 34 and 64, the top 186, walls 172 and 174 and ledges 184 of this embodiment of the prefabricated floor panel system 10 are similar to that of the first embodiment. The channels 64 are provided with reinforcing bars supported by second reinforcing bar chairs 102 as described with reference to FIGS. 6 to 8.

As illustrated in FIG. 21, one of the outermost lateral edge 18 is provided with a reinforcing bar 36 spaced away from the wall 14 and ledge 30, the reinforcing bar being supported by a plurality of a second reinforcing bar chairs 102 spaced along the length of the prefabricated panel system 10. The reinforcing bar chairs 102 are attached to the first ledge or wall such that there are no significant structures projecting from a lower surface of the first ledge. In prior systems, it is common to attach chairs using screws or bolts as is seen in the first embodiment. The use of such fastening means results in part of the fastener extending below the lower surface of the ledge. Such projections can interfere with joining of the overlying ledges 30 and 32, resulting in gaps or spaces in the joined ledges.

One way of attaching the reinforcing bar chairs 102 to the ledge 30 is to use mechanical fasteners having flat non-projecting heads and inserting the mechanical fastener from below through the hole in the ledge and then the hole in the clamp of the reinforcing bar chairs. One example of such a fastener is a rivet, particularly pop rivets as illustrated in FIGS. 21 and 22. Such pop rivets have flat, non-projecting heads which will not interfere with the joining of the overlying ledges. This is the most preferred way of attaching the reinforcing bar chairs 102 to the ledge 30.

As illustrated in FIG. 23, other possible ways of attaching the reinforcing bar chairs to the ledge 30 would be the use of a bonding agent. One example of such a bonding agent could be a suitable adhesive which can adhere the reinforcing bar chair to the ledge. Examples of such adhesives include epoxy, polyurethane, and cyanoacrylate products. The adhesive would be selected to provide the proper bond while not interfering with the curing of the poured concrete floor. Another example of a suitable bonding agent for attaching the reinforcing bar chairs to the ledge 30 would be a bead produced through soldering, brazing or welding. This would be selected to provide the proper attachment without affecting the integrity of the panel or causing deformation of the panel.

The other outermost lateral edge 20 has only ledge 32 and no reinforcing bar is present, thus providing both the upper and lower surfaces of the ledge free from interfering structures or projections to interfere with the joining of one prefabricated floor panel system 10 to another prefabricated floor panel system 10 by overlying the ledges 30 and 32 of the prefabricated floor panel systems 10 to form a channel.

Figure 24:
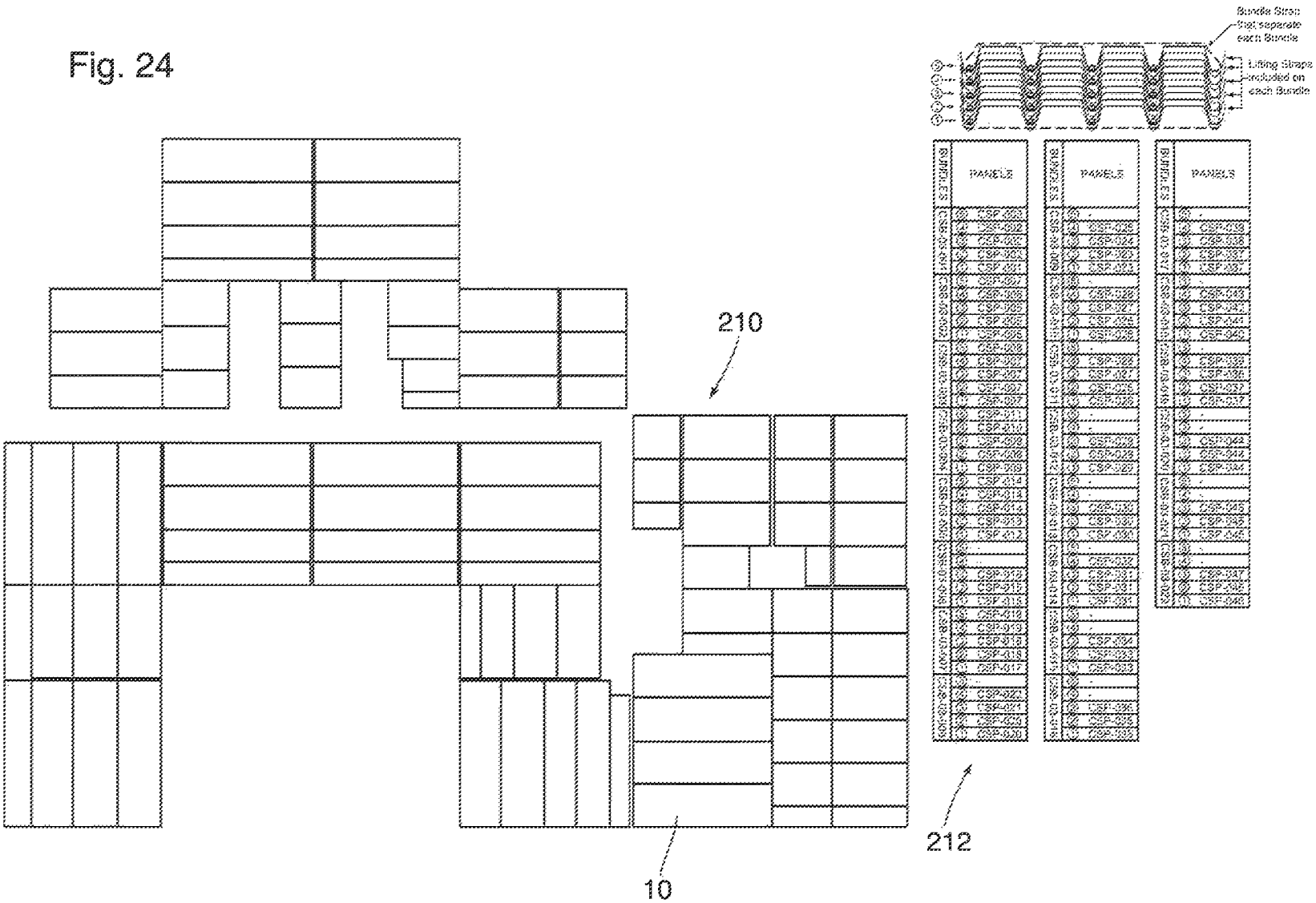
FIG. 24 illustrates a floor plan of a multi-story building illustrating the floor panel systems required and their placement for proving the formwork for a typical floor.

The prefabricated floor panel system 10 of the present invention is utilized based upon the requirements of the building to be constructed. As illustrated in FIG. 24, a floor plan 210 of the building is designed laying out each of the prefabricated floor panel systems 10 required to construct the floor. Once this done, the individual prefabricated floor panel systems 10 are fabricated in accordance with the present invention. In order to maximize the time and labor savings, a bundle floor plan 212 is designed which bundles together the prefabricated floor panel systems 10 to construct the floor such that the prefabricated floor panel systems 10 required to complete a section of the floor are bundled either together or in adjacent bundles numbered according to the order in which they will be delivered and lifted to the floor being installed.

The present invention provides for a prefabricated floor panel system used in a permanent or stay in place formwork for pouring concrete floors in a mid- to high-rise building which allows for the rapid and easy construction of the formwork resulting in reduced time and cost for the construction of mid- to high-rise buildings. The prefabricated floor panel system of the present invention has all of the necessary reinforcing bars used in the concrete floor pre installed so that the time and labor previously necessary for the installing and securing of the reinforcing bars is not required. In addition as the prefabricated floor panel systems are prefabricated, the labor and time required to move and install the individual pieces of formwork is greatly reduced. Another benefit of the prefabricated floor panel systems of the present invention is that the prefabricated floor panel systems may be delivered to the construction site just in time, reducing the amount of storage space required at the construction site as well as the time to move the materials from the ground to the floor being installed. This is of great benefit particularly in high density locations where space is at a premium and deliveries may require closing part or all of the streets adjacent to the construction site. An additional benefit of the prefabricated floor panel systems of the present invention is that they are significantly lighter than prior art floor panels which include concrete. This allows for the transport of prefabricated floor panel systems covering a significantly larger floor area than the prior art panels on a single vehicle. In addition, owing to the lower weight, the cranes at the construction site can lift more prefabricated floor panel systems in a single transfer, reducing the time required to move all of the materials required to install a floor.

Although various preferred embodiments of the present invention have been described in detail, it will be appreciated by those of skill in the art that variations may be made thereto without departing from the scope of the appended claims.

We claim:

1. A reinforcing bar chair for use in supporting at least one reinforcing bar in a floor system, said bar chair comprising:

an elongated first foot and an elongated second foot configured to be fixed within a channel of a floor system;

a first leg extending upwardly from said elongated first foot, a second leg extending upward and rearwardly from said elongated second foot;

a connection bar extending forwardly at a rear end thereof from a top end of said second leg, said connection bar being generally parallel to said second foot;

and a u-shaped saddle having a first end of said u-shaped saddle and a second end of said u-shaped saddle;

the first end of said u-shaped saddle coupled to a top end of said first leg;

and a second end of said u-shaped saddle coupled to a forward end of said connection bar;

said u-shaped saddle sized to receive and support a portion of reinforcing bar in a manner that a portion of the reinforcing bar is aligned with the connection bar;

said elongated first foot and elongated second foot are fixed to a channel floor of a floor system using a clamp;

the clamp being configured to capture the elongated first foot and elongated second foot between a lower surface of the clamp and the channel floor;

the clamp being attached to the channel floor by a suitable fastening means.

2. A reinforcing bar chair as claimed in claim 1 wherein said first foot is generally perpendicular to said first leg.

3. A reinforcing bar chair as claimed in claim 1 wherein said first leg extends upward and rearwardly from said first foot.

4. A reinforcing bar chair as claimed in claim 3 further comprising a second connection bar positioned between said first leg and said U-shaped support;

said second connection bar having a first end of the second connection bar extending forwardly from the top end of said first leg and oriented generally parallel to the channel floor and a second end of the second connection bar coupled to a second end of the U-shaped support; and a second extension arm with a first end extending forwardly from the top end of said second leg and oriented generally parallel to the channel floor, said U-shaped support connected to a second end of said second extension arm which connects said second extension arm to said first extension arm.

5. A reinforcing bar chair as claimed in claim 4 wherein said saddle includes two U-shaped supports between the first extension arm and the second extension arms.

* * * * *